US012472424B1

(12) United States Patent
Curley

(10) Patent No.: US 12,472,424 B1
(45) Date of Patent: Nov. 18, 2025

(54) METHOD OF CONDUCTING A MULTI-DECK CARD GAME

(71) Applicant: Charles M. Curley, Cortland, NY (US)

(72) Inventor: Charles M. Curley, Cortland, NY (US)

( * ) Notice: Subject to any disclaimer, the term of this patent is extended or adjusted under 35 U.S.C. 154(b) by 0 days.

(21) Appl. No.: 19/060,723

(22) Filed: Feb. 23, 2025

Related U.S. Application Data

(63) Continuation of application No. 18/827,764, filed on Sep. 8, 2024, now Pat. No. 12,268,953.

(51) Int. Cl.
*A63F 1/12* (2006.01)

(52) U.S. Cl.
CPC ..... *A63F 1/12* (2013.01); *A63F 2250/58* (2013.01)

(58) Field of Classification Search
CPC ..... A63F 1/12; A63F 1/14; A63F 2250/58; A63F 3/00157; A63F 1/00; A63F 2001/005; A63F 2001/003; A63F 1/04; A63F 2001/001
See application file for complete search history.

(56) References Cited

U.S. PATENT DOCUMENTS 564,774 A * 7/1896 Becker ..... A63F 1/12 273/149 R
4,522,400 A * 6/1985 Trilli ..... A63F 1/14 273/148 A
2018/0200610 A1* 7/2018 Riordan ..... A63F 1/12

* cited by examiner

*Primary Examiner* — Michael D Dennis
(74) *Attorney, Agent, or Firm* — Chris Tanner; FYPA PLLC

(57) ABSTRACT

The invention herein describes a card handling device used for automatically shuffling two card decks sequentially for use in a novel casino card game. The device shuffles a first deck and moves it to a first output tray and then shuffles a second deck which is moved to a second output tray. A microcontroller randomly decides which deck is to be moved to which output tray. A moveable hood obscures observation of the two output trays while the shuffling and deck movements are underway. Thereafter, the hood is moved to permit viewing and access of the two play-ready card decks simultaneously. One player is chosen as a game "HOST" and thereafter chooses which of the two decks to utilize for a subsequent card game whereupon the game "HOST" or other players may become advantaged by certain nonconventional cards.

18 Claims, 19 Drawing Sheets

(1997)

(1997)

(2003)

(2003)

METHOD OF CONDUCTING A MULTI-DECK CARD GAME

FIELD OF INVENTION

The present invention is related to the field of casino grade automatic card shuffling machines, which are used by casinos to speed up the rate of play of dealer-hosted card games. More particularly, the invention relates to shuffling machines which randomize the rank and suit of cards within a deck of playing cards for use in various types of card games.

BACKGROUND

Card games are the most popular type of table games utilized by casinos. They provide excitement, chance and entertainment to the players while also providing steady revenue for the casino. Players are attracted to new and novel card games that are challenging, exciting, easy to learn and easy to win. Casinos are interested in novel card games that move quickly in order to sustain revenues. Accordingly, the objectives of the present invention are to provide a novel card game device and associated game that will attract players because it is easy to learn, moves quickly, and provides more mystery and chance than conventional casino card games.

Card games such as Blackjack and various forms of poker are major attractions in casinos because they are relatively easy to play and allow wagering to various degrees of risk. A single deck of 52 playing cards are often used in these games, which must be periodically shuffled to effect randomness of the rank and suit of the individual cards within the deck. It is to the advantage of the casino to reduce the time that a dealer handles and shuffles playing cards between games, thereby increasing revenues. Casinos thus use automatic shuffling machines to speed up the rate of play at gaming tables, thus retaining the interest of the players and sustaining the rate of play.

Some shuffling devices are called "hand-forming" shufflers because they discharge subsets of a shuffled deck as play-ready hands, one hand at a time. These shufflers are used in various types of poker games. Other shufflers discharge an entire shuffled deck at one time, whereupon a dealer may move the shuffled deck to a dealing shoe where he/she peels cards from the shoe as needed in the game. Such shufflers are commonly used at Blackjack tables.

The card handling device being described herein discharges two shuffled decks to a discharge portal having two output trays. The players at a casino table are presented with two shuffled card decks simultaneously from which the players or a dealer may choose one or two decks for proceeding with a subsequent novel card game. Because the card handling device herein is novel, it is expected that such a device will precipitate the evolution of new card games that are not yet invented at the time of this disclosure. One such novel card game is explained herein, and that game is hereafter referenced herein as "the game". The card handling device being described herein is hereafter referred to as "the game device".

The operational principle underlying the game device herein is briefly described by FIG. 1 through FIG. 4. FIG. 1 is a perspective view of the preferred embodiment as it would appear on a gaming table in a casino. The game device has a touch screen 114 and two card deck input portals 120 and 130 on its upper surface for receiving card decks. A first input portal 120 is labeled "UNSHUFFLED DECK" and a second portal 130 is labeled "SHUFFLED DECK". The game device additionally possesses a movable hood 155 which obscures visibility of a discharge portal 140 which possesses two shuffled card output trays 142 and 144. Each output tray receives game-ready decks that are disgorged from within the game device.

The hood 155 is kept in a first position (closed) as shown in FIG. 1 while two card decks undergo processing within the game device, which includes shuffling and verification. FIG. 2 illustrates the condition when the hood 155 is displaced to reveal the two output trays 142 and 144 within discharge portal 140. The output trays 142 and 144 contain no cards in this illustration.

FIG. 3 illustrates a closer view of output portal 140 when the hood 155 is displaced to reveal two game-ready card decks 604S and 606S located in two output trays labeled as tray "1" and tray "2". In one embodiment, a player must choose which of the two decks to be utilized for the subsequent card game. The remaining deck will be recirculated into the game device 100.

The operator of the game device is also the dealer who is responsible for conducting a card game which utilizes the game device. FIG. 4 illustrates an example where deck 606S was resident in output tray "2" and is chosen for utilization in the subsequent card game. That deck 606S will be removed by the dealer and placed in a shoe for utilization in the subsequent card game. The dealer will thereafter remove the remaining shuffled deck 604S to the second portal 130 which is labeled "SHUFFLED DECK", where it will remain deposited until the subsequent game has been completed with the deck 606S.

During the subsequent game, the shuffled deck 606S is transformed into unshuffled deck 606U. When it becomes time to shuffle the deck 606U for the next game, the dealer will insert the unshuffled deck 606U into the portal 120 which is labeled "UNSHUFLLED DECK" and close the hood 155. After a sensor detects presence of the unshuffled 606U, the game device will internally move the previously shuffled deck 604S from the "SHUFFLED DECK" portal 130 to either output tray "1" or output tray "2". The destination tray for deck 604S is unknown to the dealer or the players. After the shuffling of deck 606U is completed by the game device 100, that deck is transformed into shuffled deck 606S. The newly shuffled 606S will be moved internally to the remaining unoccupied output tray at output portal 140. The hood 155 obscures these deck movements such that neither the dealer nor the players can observe which deck was moved to which output tray or in which sequence.

The dealer will thereafter displace the hood 155, revealing two decks 604S and 606S which are play-ready for the next game as shown in FIG. 3. The players or the dealer cannot know which of the two play-ready decks was just utilized in the previous game.

An example of a novel card game which utilizes this game device will be explained below whereupon one player is designated as a "HOST" who thereafter chooses one of the two play-ready decks to use in a subsequent card game. The HOST may become advantaged by certain unconventional cards which are embedded in one of the two card decks. FIG. 4 summarizes part of the operational procedure for initiating such a novel card game.

The unique features of the game device and game described herein will become better understood with reference to the descriptions, drawings and claims which are presented below.

DETAILED DESCRIPTION OF THE PREFERRED EMBODIMENTS

A casino-grade game device for automatically shuffling and presenting two game-ready decks simultaneously for utilization in a subsequent card game is described for utilization in a card game intended for use at a casino table that accommodates seven player stations. The game device can be programmed by a dealer for the game parameters and can thereafter randomly designate a table position that identifies a player to act as the symbolic "HOST" for the game.

For purposes of this explanation, the term "unshuffled deck" is defined as a deck of cards in need of being shuffled (randomized) and verified. The term "shuffled deck" is defined as a deck of cards that has been transformed from a "unshuffled deck" into a shuffled (randomized) deck. The term "verification sensor" is defined as a sensor that can interrogate a playing card for interpretation by a microcontroller. In the most rudimentary form, an interrogation sensor may merely detect the passing of a card along a card path such that the microcontroller can accumulate a card count. In more sophisticated forms, an interrogation sensor may take the form of a miniature camera that can photograph a passing card such that a microcontroller can interpret its suit and rank as is known in the art. The definition of a "fault criteria" is the criteria used by a microcontroller to determine the suitability of a card or card deck after interpreting the "verification sensor". In its simplest form, a "fault criteria" may be the number of cards that have passed the "verification" sensor within a given operational span.

The definition of a "faulty deck" is a card deck that has failed to satisfy a "fault criteria", for example a card deck having a count of 51 cards when the microcontroller anticipated a count of 52 cards. Conversely, the microcontroller identifies a "play-ready deck" as a card deck that has been shuffled and successfully avoided its "fault criteria" after interrogation by the "verification sensor". It is understood that the "fault criteria" utilized by the microcontroller in the game device being described herein can be adjusted according to the sophistication of its "verification sensor", where the sophistication of that sensor is a designer's choice. The term "output tray" is defined as a tray which temporarily stores "play-ready decks".

The term "table stakes" is sometimes referred to as the "betting pool" and is defined as the sum of all player's bets as put forward on a casino table before and during a card game. The term "substack" defines a stack of cards comprising less than a full deck. The term "the game" is defined as meaning the unique card game being described herein.

Figure 1:
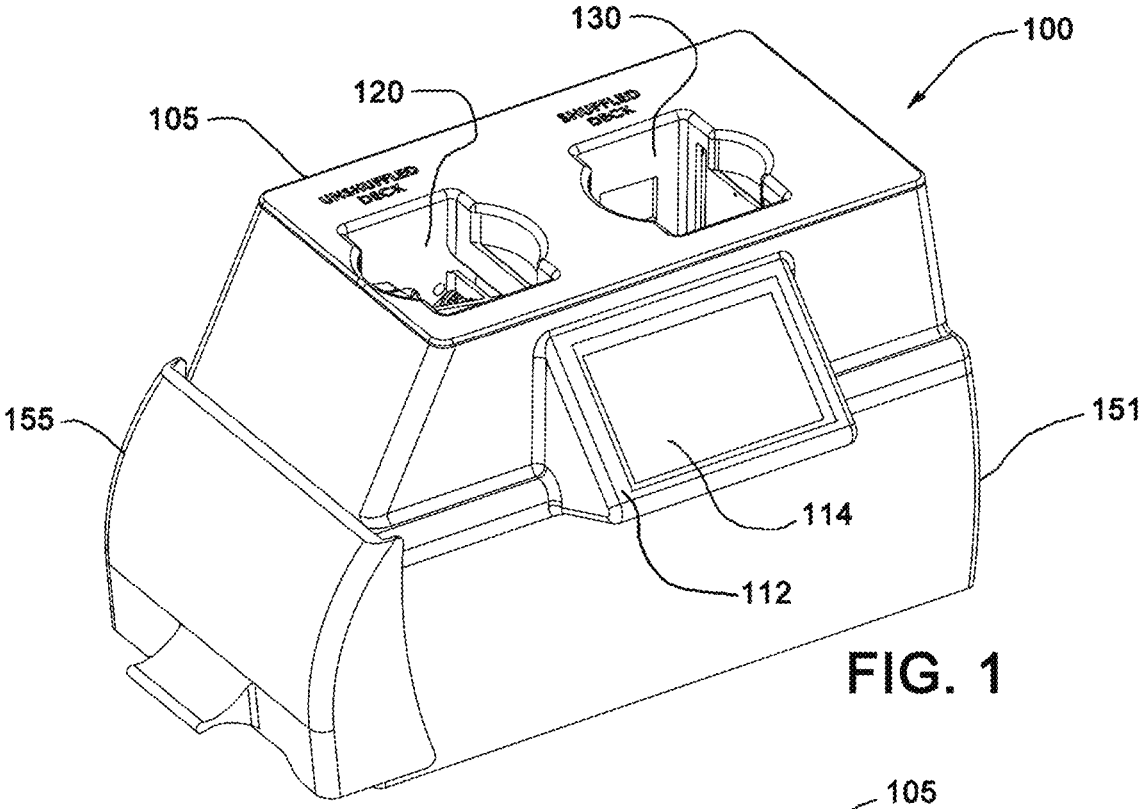
FIG. 1 is a perspective view of the game device described herein as it would appear on a casino table with its hood in place to prevent viewing of the card decks within its output portal.

FIG. 1 illustrates a preferred embodiment of the electromechanical game device disclosed herein as it would appear on a casino table. The game device 100 comprises a first portal 120 consisting of a recessed cavity for receiving a new or unshuffled deck of playing cards, and a second portal 130 consisting of a recessed cavity 130 for receiving a previously shuffled deck. A hood 155 covers an output portal 140.

Figure 2:
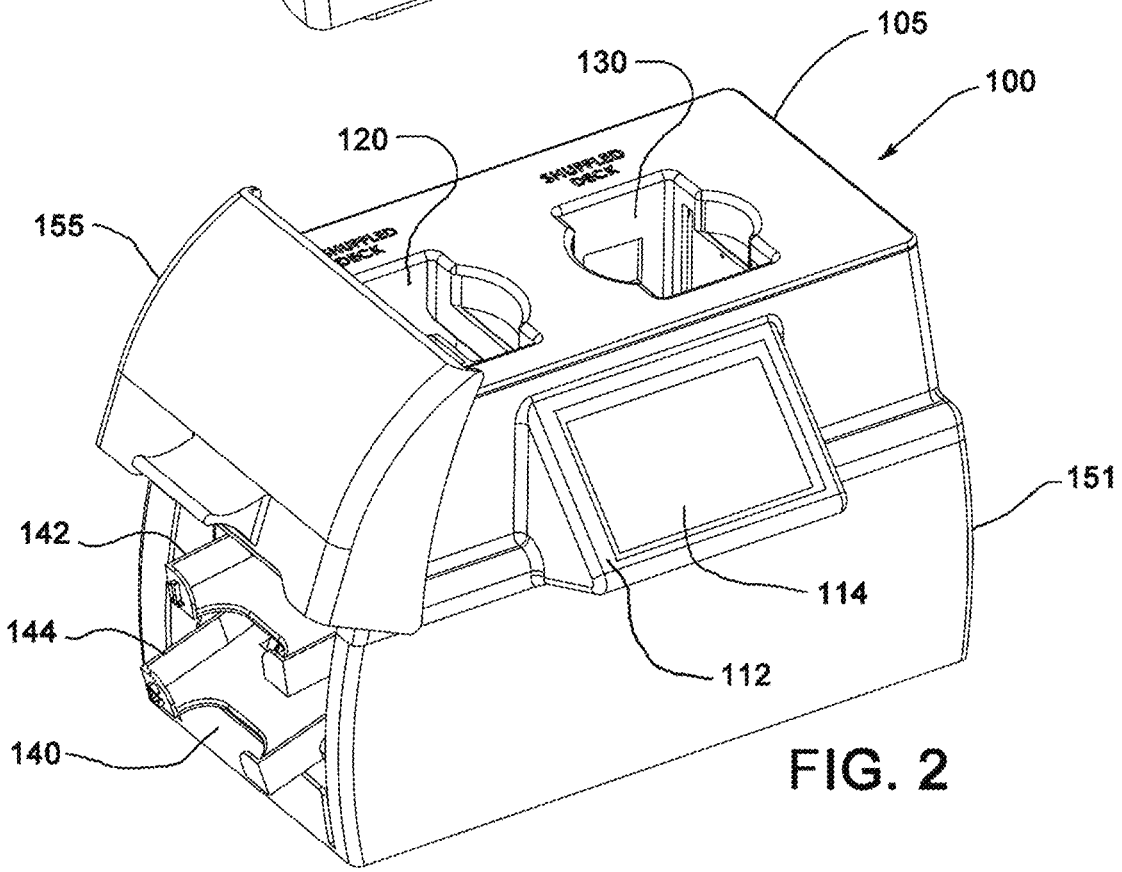
FIG. 2 is a perspective view of the game device described herein as it would appear on a casino table with its hood displaced to view two vacant card output trays in its output portal.
Figure 3:
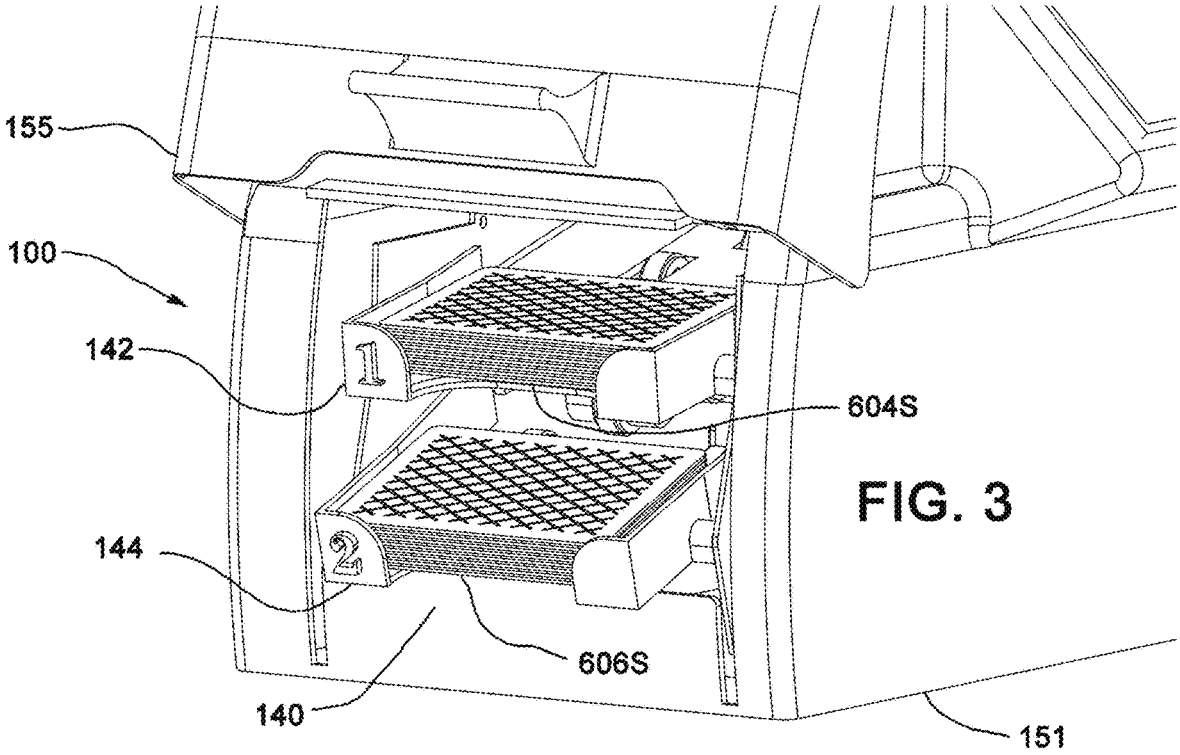
FIG. 3 is a perspective view of the game device described herein as it would appear on a casino table with its hood displaced to view two game-ready card decks in its output portal.

The output portal 140 is shown in in FIG. 2 whereupon it has been revealed after displacing the hood 155 to its "open position". Output portal 140 is utilized to automatically disgorge two play-ready decks from the game device 100. Two numbered output trays 142 and 144 reside within output portal 140 for temporarily storing play-ready decks as shown in FIG. 3.

Casing 151 supports a control panel 112 as shown in FIG. 1. The control panel 112 is positioned conveniently for a casino dealer on the exterior of the housing and comprises a touch screen 114. At least one microcontroller (not shown) controls the operation of the game device, including operation of the touch screen 114 which is used to both input commands and to display conditions within the game device, including fault conditions and progress conditions. Touch screen 114 is a small 5-inch touchscreen that is used to program the shuffler for various games. For size reference, a 5-inch touchscreen is slightly smaller than the smaller touchscreens used in today's smallest mobile phones. Prior to each game, the dealer may utilize the touch screen 114 to program the game device for tailoring the game rules and the number of seated players. The touchscreen will also indicate possible malfunctions and security issues to the dealer.

The game device 100 may be placed upon a casino table surface near the dealer and within arm's reach, such that the dealer may easily insert and withdraw card decks from the recessed cavities 120, 130 and withdraw play-ready decks from the portal 140. All of the portals of the game device 100 must be viewable by the players.

Figure 5:
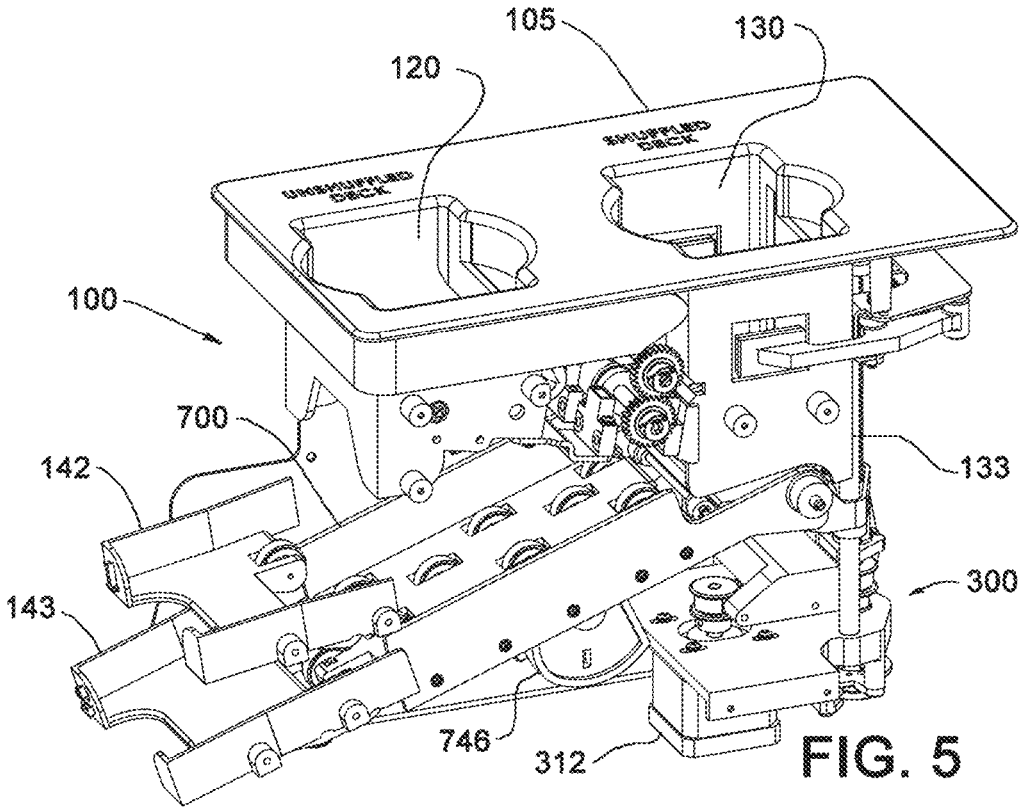
FIG. 5 is a perspective view of the game device herein showing the internal chambers and card paths with no cards present.

FIG. 5 shows an isometric view of the game device 100 with the casing 151 and hood 155 removed. The various components are supported by side frames, and one side frame has been removed from the view to reveal the internal chambers. An elevator mechanism 300 is located directly below the portal 130, and a discharge track 700 is shown sloping away from a lower portion of a randomizer chamber housing 133. In general, unshuffled cards are deposited into the input portal 120 and thereafter passed individually into the randomizing chamber within housing 133 where they are randomized. Play-ready decks are then moved downward to a transfer roll 743 where they are removed from the elevator to the discharge track 700 which moves the card decks to one of two output trays 142 or 144. Faulty decks are instead moved upwards to the cavity which defines portal 130.

Figure 6:
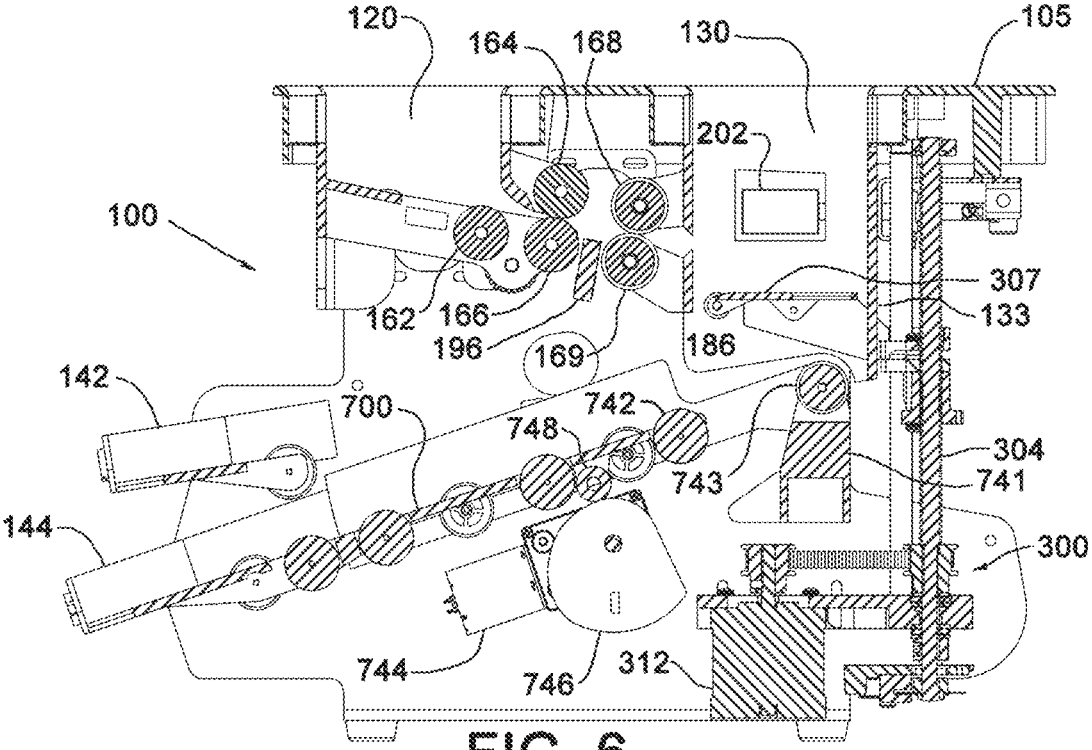
FIG. 6 is a side elevational section view which illustrates the basic layout of the card paths.

The anatomy of the game device 100 is briefly explained by the section view shown in FIG. 6, which is devoid of any card decks. The unshuffled deck input portal 120 is shown near the top left of the view. Feed rolls 162, 166 and 164 are utilized to move individual cards past a verification sensor 196, and additional feed rolls 168 and 169 move individual cards into the randomizer chamber 186. The housing 133 possesses four walls which contain card decks with slight clearance around the periphery, thus forming the randomizing chamber 186. After the deck is randomized and successfully verified, the card deck will be supported upon elevator platform 307 which is moved vertically by the lead screw 304 in elevator assembly 300. The elevator platform 307 moves a play-ready deck downward until it contacts a transfer roll 743. Contact with the transfer roll 743 causes the deck to rotate CCW and slide downward along the rolls 742 of the discharge track 700. In FIG. 6, the discharge track 700 is aligned with the axis of output tray 144. The discharge track 700 may alternately be aligned with the axis of output tray 142. A cam 746 is utilized to align the discharge track with either of the two output trays after the microcontroller has designated the destination of a card deck randomly.

Figure 7A:
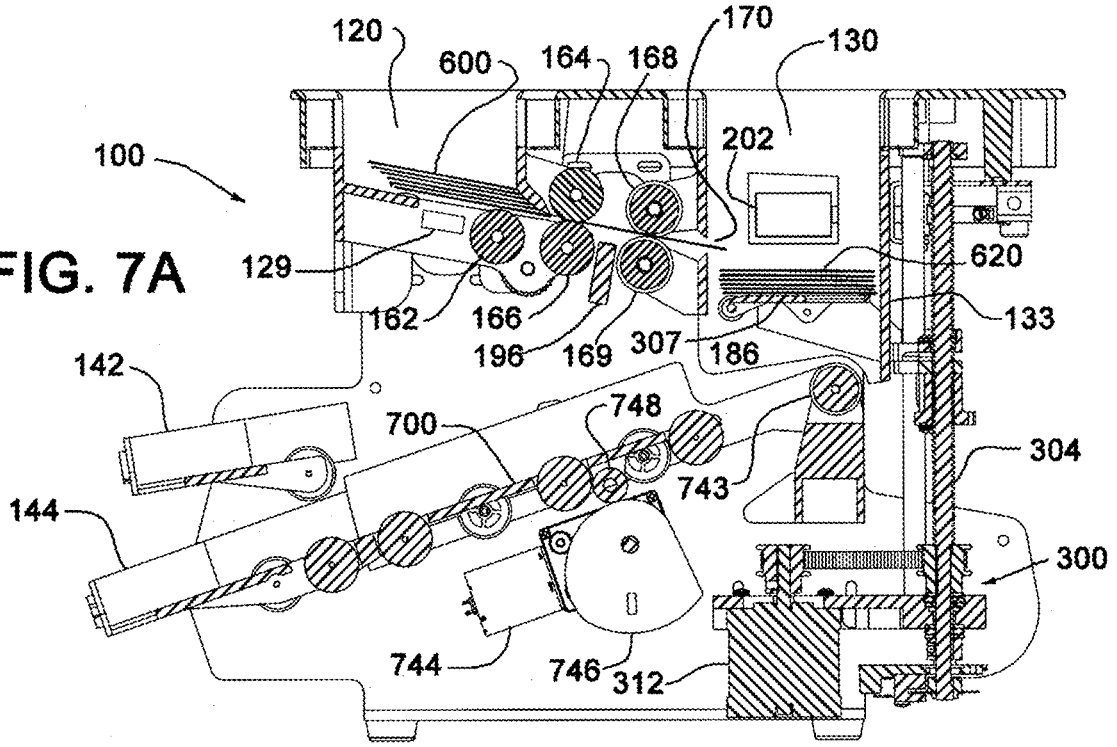
FIGS. 7A, 7B, 7C, 7D, 7E and 7F are side elevational views of the game device herein which stepwise illustrate the migration of playing cards as they move through the game device to the output trays.
Figure 7B:
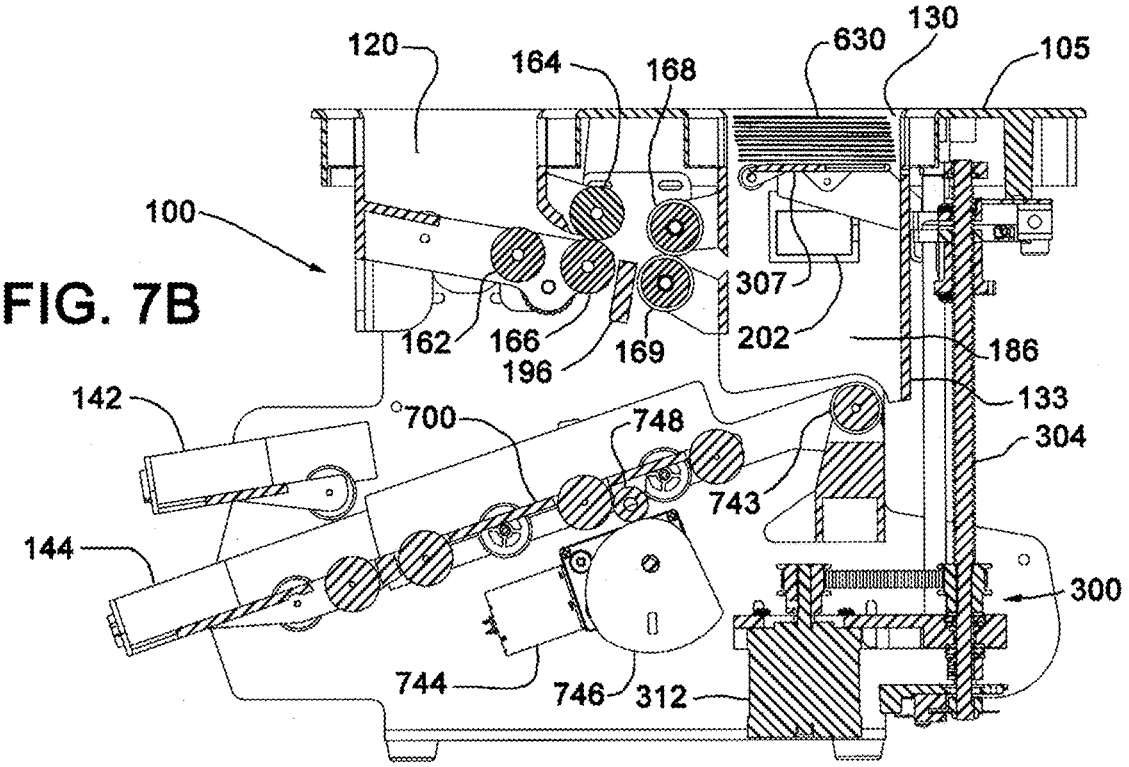

In the case that a shuffled deck has been found to be faulty, the elevator will move the faulty deck upwards to reside within the portal 130 as shown in FIG. 7B, and the dealer will be alerted to remove the faulty deck from portal 130. The portal 130 is therefore defined as a dual-use portal because it is used to discharge faulty decks from the game device and also used to receive game-ready decks into the game device.

A more detailed explanation of the card movements can be observed from FIGS. 7A, 7B, 7C, 7D, 7E and 7F, which explain the movement of card decks within and through the game device 100. FIG. 7A shows a new or spent deck 600 (unshuffled) located in the input portal 120 as the deck is being shuffled. When the dealer activates a shuffle command on touch screen 114, the microcontroller interrogates sensor 129 to determine if any card is present in the portal. If a card is detected by the sensor 129, the microcontroller will activate motors (not shown) that rotate feed rolls 162, 166 and 164 until the leading edge of a card is detected by verification sensor 196.

In FIG. 7A, an unshuffled card of a card deck 600 is moved face down past the verification sensor 196 and is about to enter the randomizing chamber 186, where the card stack 620 is supported by elevator platform 307 of the elevator assembly 300. The microcontroller activates a motor (not shown) to rotate feed rolls 168 and 169 which feed the cards of the card stack 600 into the randomizing chamber 186 through a slot 170 in the housing 133. In a rudimentary embodiment, the verification sensor is utilized to count the cards within the deck being processed. In more advanced embodiments, the verification sensor 196 is utilized to read the rank and suit of each card in addition to counting the cards in the deck. The sensor 196 may be any optical recognition sensor as taught in the prior art, including a reflective opto-sensor, a digital camera, CMOS camera, color pixel sensor or a CCD image sensor. In the preferred embodiment, the sensor 196 is a CCD image sensor and is used to read the rank and suit in the upper right corner of each card. This optical recognition process will continue until sensor 129 signals that no more cards are available in the card input portal 120. Upon completion of the deck insertion into the randomizing chamber 186, the microcontroller will determine if any fault condition exists, which may include card shortages, extra cards, flipped cards or unreadable cards.

After the randomizing cycle is completed, the microcontroller decides if a card deck is faulty. If the card deck is faulty, the elevator platform 307 will raise the rejected card deck 630 to the dual use portal 130 as shown in FIG. 7B and signal the fault condition on the touch screen 114. The automatic rejection of a faulty card deck relieves the dealer of any distraction or interruption in table play that would otherwise require a dealer to tediously unload a shuffling apparatus as in the case of conventional compartment type shufflers. Moreover, the game device denies the dealer the discretion to continue play with a corrupt card deck as in the case of cheating or player-dealer collusion.

Figure 7C:
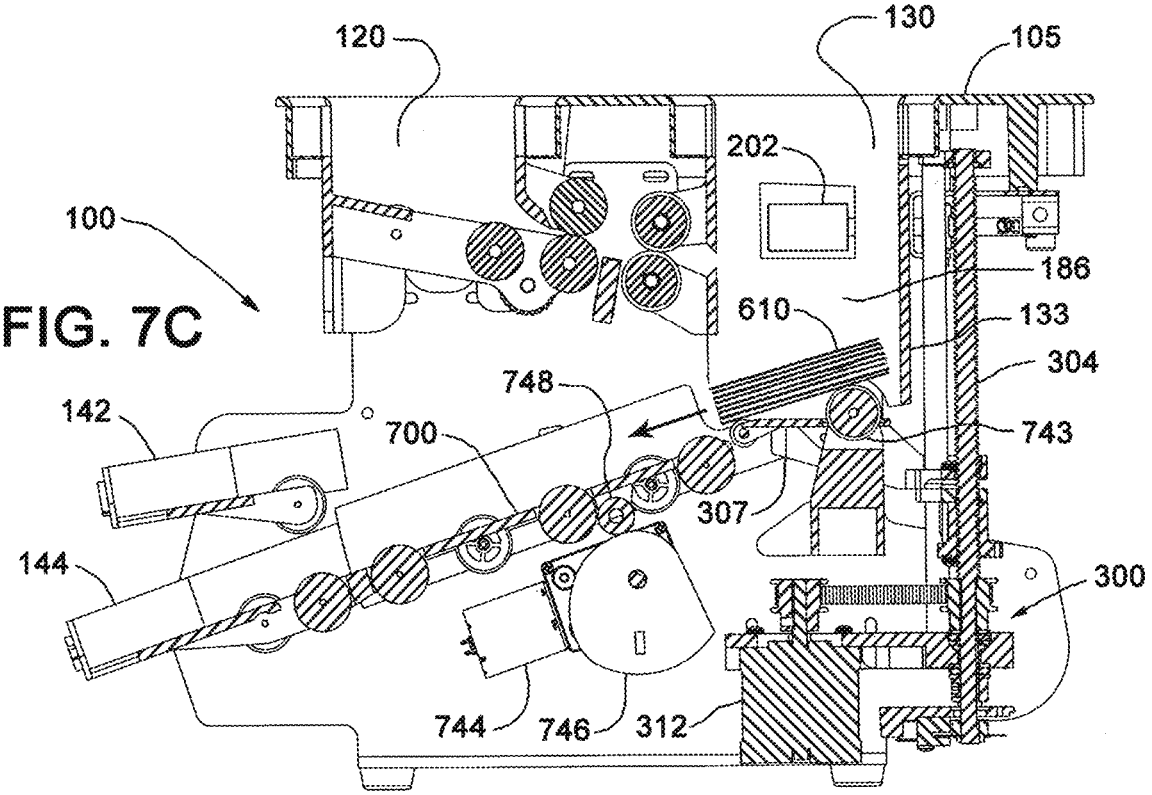
Figure 7D:
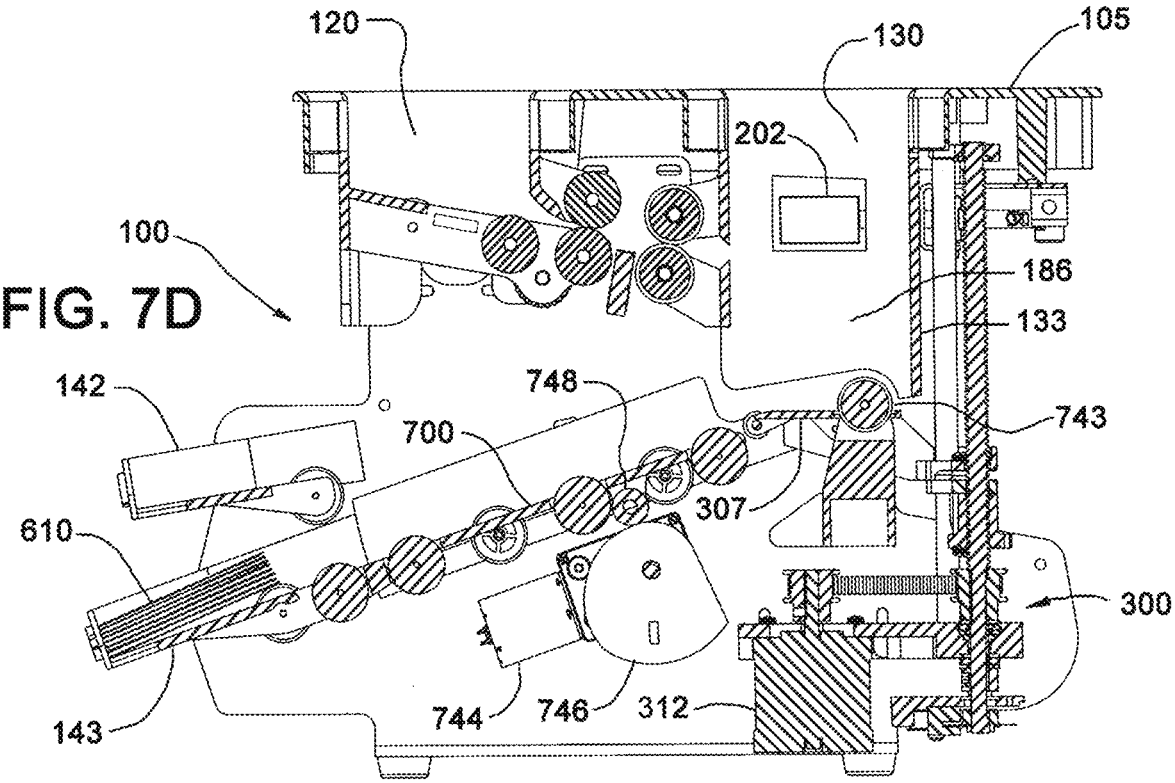

FIG. 7C illustrates the case in which the microcontroller has determined that a card deck is not faulty and lowered the elevator platform 307 to a position below the transfer roll 743. An opening in the elevator platform 307 allows the transfer roll 743 to pierce the platform and rotate the deck 610 CCW, allowing centrifugal force to remove the card deck from the elevator platform. The centrifugal force discharges the deck 610 in the direction of the arrow along rollers of the discharge track 700. FIG. 7D shows the play-ready card deck 610 at its terminal position in output tray 143.

Figure 7E:
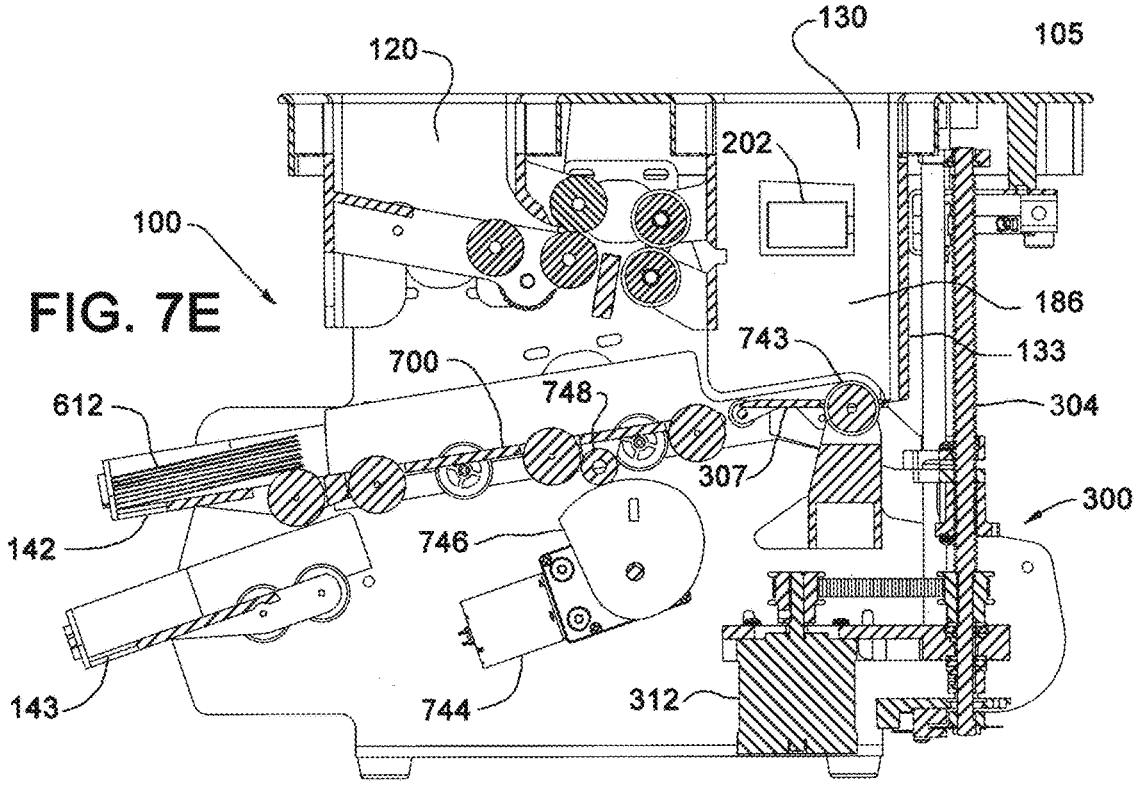
Figure 7F:
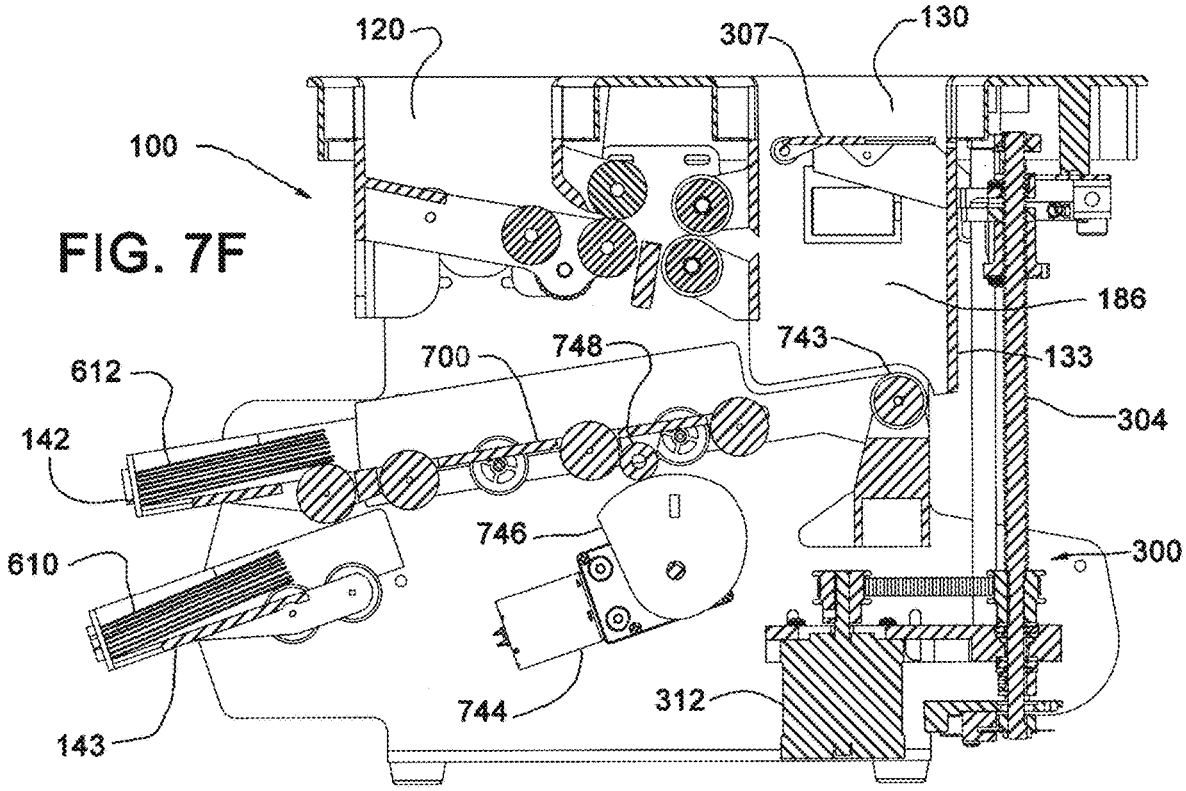

The discharge track 700 is rotatable about an axle that is coincident with the center of transfer roller 743 and may assume two different orientations which align its axis with either output tray 142 or output tray 143. In FIG. 7D, the discharge track is aligned with output tray 143. In FIG. 7E and FIG. 7F, the discharge track is alternately aligned with the axis of output tray 142. Referring to FIG. 7D and FIG. 7E, the discharge track is supported by a cam follower roll 748 which rests upon a cam 746 which is rotated by a DC motor 744.

The cam 746 raises and lowers the discharge track 700 by rotating the track 700 about a stationary pivot which is coincident with the center of transfer roll 743. The cam 746 has assumed a first position where it has lowered the discharge track to align with output tray 143 in FIG. 7D. The cam has rotated to a second position in FIG. 7E to align the discharge track with output tray 142. As will explained in more detail below, the microcontroller randomly chooses one of the two cam positions, and thus the discharge tray attitude, depending upon events.

The randomizing cycle comprises a series of motions performed by the apparatus to sort the individual cards into a randomly arranged deck within the chamber 186. The randomizing cycle will automatically start when the dealer activates a "Shuffle" command on the touch screen as long as sensor 129 detects the presence of a card in the input portal 120. Referring to FIG. 7A, a series of feed rolls 162, 166, and 164 strip the bottom card from the stack of cards 600 and move that card past the verification sensor 196. Feed rolls 168 and 169 then inject each card into the randomizer chamber 186, whereupon each card is inserted into a growing card stack 620.

Figure 8:
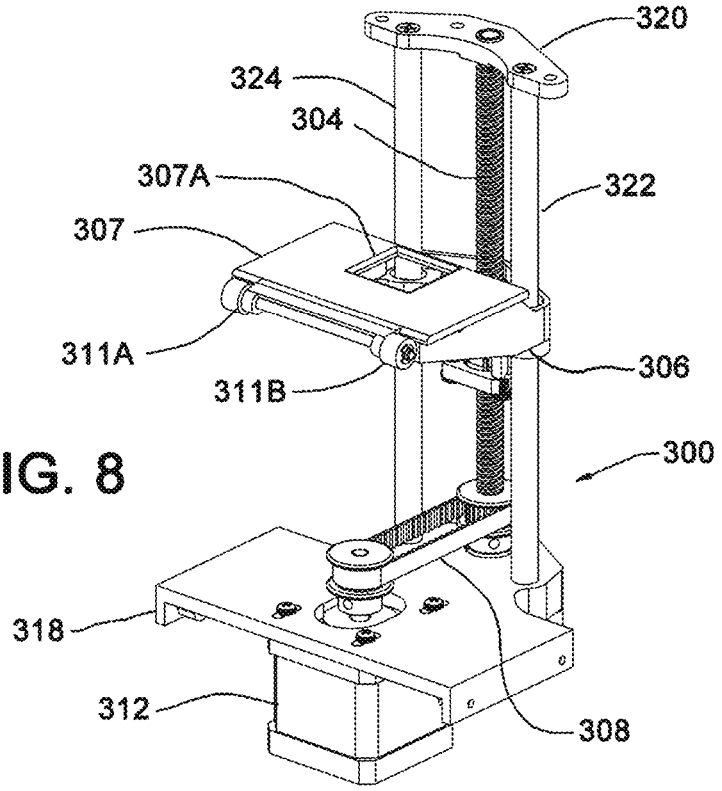
FIG. 8 is an isometric view of the elevator module.
Figure 9:
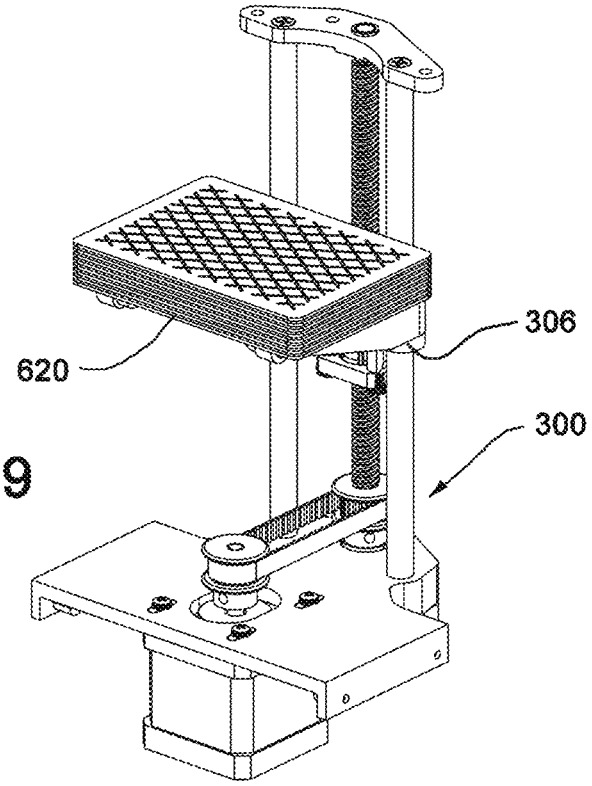
FIG. 9 is an isometric view of the elevator module showing the position of a stack of randomized cards.

The randomizing chamber 186 possesses an elevator platform 307 which supports the card stack 620 during randomization and moves the card stack 620 with oscillation motion in a direction parallel to the walls within the randomizing chamber 186 (FIG. 7A). The structure of the elevator assembly 300 and its driving means is shown in FIG. 8. The elevator assembly 300 has a platform 307 which is moved vertically by motion of a lead screw 304. The elevator surface 307 supports card stacks as they are moved vertically within the randomizing chamber 186. Guide shafts 324 and 322 prevent torsional movement of the platform 307, and are attached to platform 318 to which a stepper motor 312 is mounted. The upper portion of elevator assembly 300 is stabilized by bridge 320. The stepper motor 312 rotates the lead screw 304 by means of a timing belt 308. The orientation of a card stack 620 is shown when in transit on the elevator in FIG. 9. As shown in FIG. 8, the platform 307 is supported by two elevator arms 306 which penetrate the randomizing chamber 186 through access slots (not shown) in the wall 133 of the randomizing chamber 186, such that the elevator arms 306 may move freely in a direction parallel to the chamber walls. At the same time, the card stack on the elevator platform 307 is loosely constrained laterally on four sides by the chamber walls of randomizing chamber 186.

Figure 10:
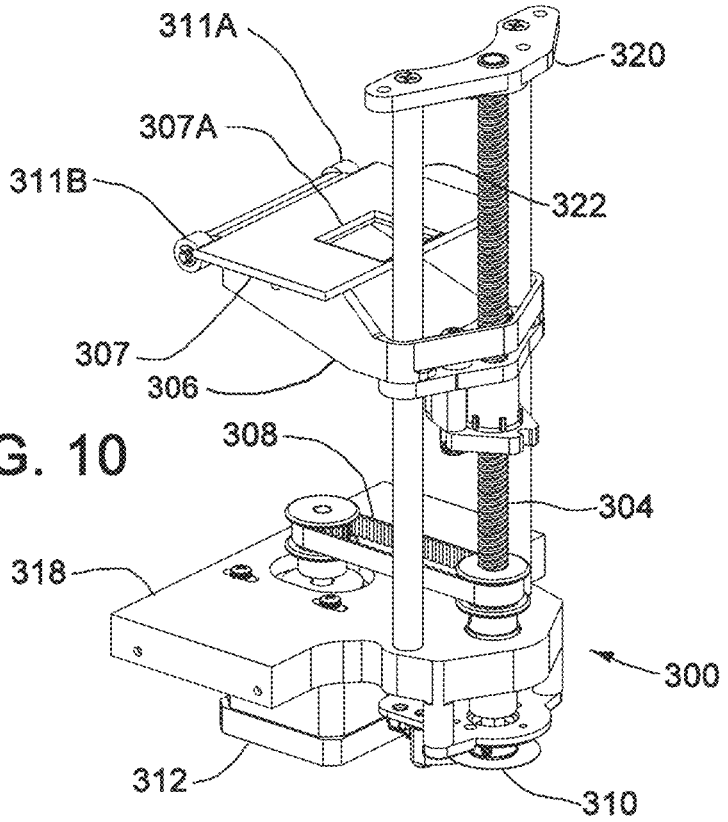
FIG. 10 is an isometric view of the elevator module showing its encoder position.

The elevator movement is controlled in very fine increments by the stepper motor 312 in conjunction with an incremental encoder 310 which is mounted to the lead screw 304 as shown in FIG. 10. An encoder disc of the incremental encoder 310 has 200 increments per revolution which corresponds to each step of a 200 step per revolution step motor. The ratio of the lead screw 304 rotation to the elevator platform 307 linear motion is 4 millimeters per revolution. The stepper motor 310 can therefore control the elevator platform 307 in increments of 20 microns, where 1 micron equals one-millionth of a meter. The thickness of a typical playing card is approximately 300 microns. Thus, the stepper motor can therefore move the elevator platform 307 with the precision of 1/15th of the card thickness. In other words, 15 motor steps move the elevator platform 307 one card thickness. This high ratio makes the elevator mechanism controllable in fine increments, thus intolerant to positional error. Rather than the incremental encoder 310, other types of sensors could be used to monitor the linear movement of the elevator, as is known and practiced in the art.

Figure 29:
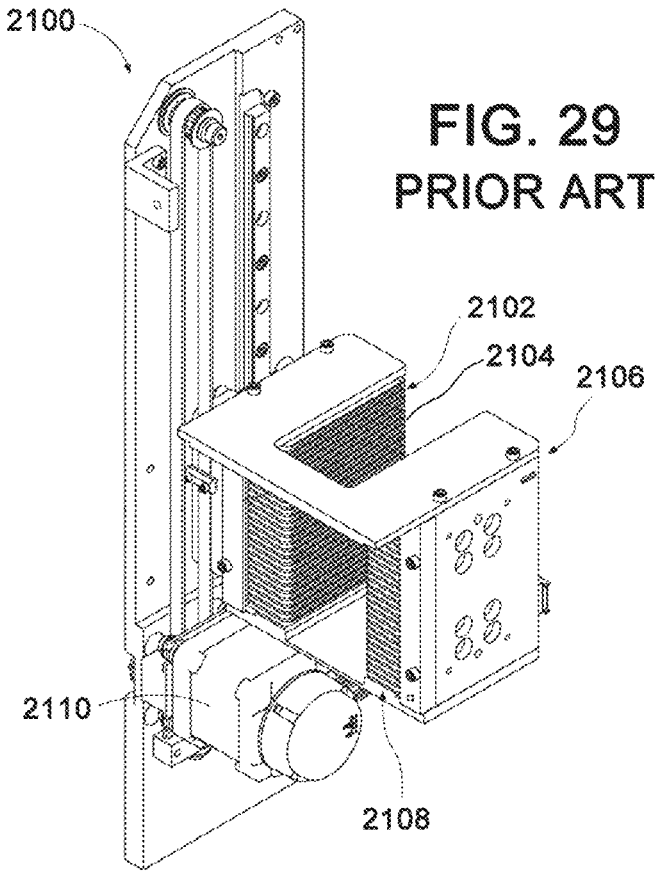
FIG. 29 PRIOR ART
FIG. 29 is an isometric illustration of a prior art shuffling device whose elevator comprises a narrow slot comb.

The simplicity of the elevator is a reliability advantage of the game device being explained herein. Many card shufflers in the art utilize elevators with narrow slots which are intolerant of bent or warped cards. For example, the problem of narrow slots is disclosed within the disclosure of U.S. Pat. No. 11,338,194 (Helgesen '194) which is illustrated herein as FIG. 29. Helgesen '194 utilizes a vertically oscillating comb with narrow card slots. As shown in FIG. 29, a card storage device 2100 possesses a vertically moving rack 2106 which comprises slotted assemblies 2102 and 2108 into which individual cards are inserted. Helgesen '194 explains that the card rack 2106 is configured to translate in the vertical direction along a linear path- and that the card storage device 2100 includes a motor 2110 configured to drive movement of the rack 2106 up and down in the vertical direction. Each card storage compartment has a slot 2104 in the first side bracket assembly 2102 and a corresponding and complementary slot 2104 in the second side bracket assembly 2108.

Helgesen '194 additionally discloses the intuitive observation that inserting bent or warped cards into narrow slots is problematic. Helgesen '194 states:

> "For example, one card in a deck may be bent or warped—causing the card to regularly fail to insert into its assigned upper or lower position during each shuffle." (Helgesen '194 col. 28; lines 63-65)

A simpler, and therefore more reliable randomizing mechanism was taught by prior art (1997) U.S. Pat. No. 5,683,085 (Johnson '085), which discloses a randomizing apparatus that is devoid of narrow-slotted combs, racks and compartments. As shown herein as FIG. 30, Johnson discloses a shuffling apparatus which possesses a "main shuffling chamber" 2200. A mechanical gripping member 2208 is attached to a mechanical gripping arm 2206 which can move vertically to random positions in chamber 2200 as commanded by a microprocessor. The arm 2206 grips and the lifts sub-stack 2202 at random positions which enables the insertion of an individual card 2210 from a secondary deck (unshuffled deck) 2212. The separating mechanism creates an opening between two sub-stacks 2202 and 2204, which allows the insertion of card 2210 from the secondary stack 2212 into the receiving stack at the opening. Johnson '085 simulates the well-known action that a dealer utilizes to manually insert a "cut card" into a deck as illustrated herein by FIG. 14A.

Subsequent prior art (2003) U.S. Pat. No. 6,631,982 (Grauzer '982) also adopted the Johnson gripper. Whereas Johnson '085 has elevated the gripper to select a subset of cards, Grauzer '982 discloses that the gripper is held stationary, while the platform below is vertically lowered away from the gripper. The shuffler described in Grauzer '982 has a disadvantage because only one deck can be processed at a time. The elevator is used to support the final shuffled card deck in the output tray, thus preventing the use of the elevator for additional shuffling until the deck is removed by the dealer.

Figure 30:
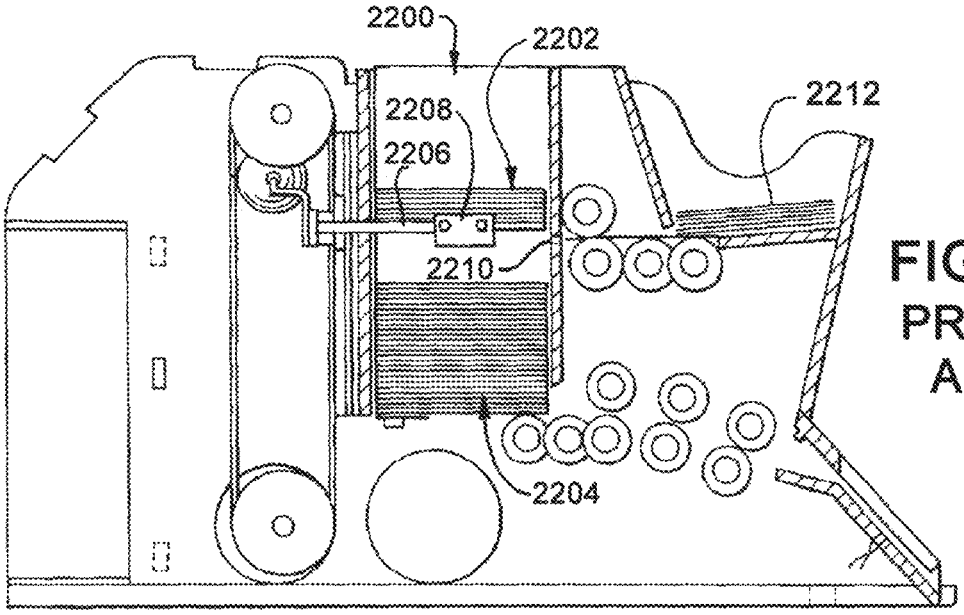
FIG. 30 PRIOR ART
FIG. 30 is a side elevation view of a prior art shuffling device that utilizes a slot-less elevator.
Figure 31A:
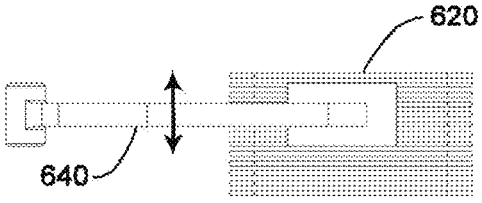
FIG. 31A PRIOR ART
FIGS. 31A and 31B illustrate the sequence of movements for injecting a card into a stack as taught by a prior art (1997) shuffling device.
Figure 31B:
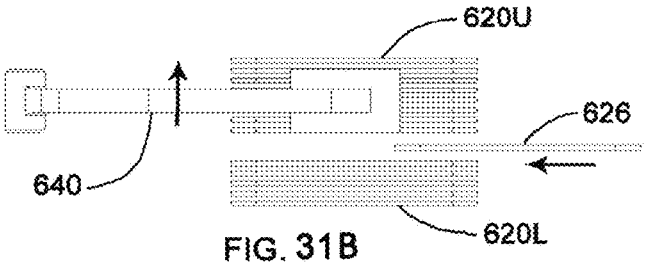
FIG. 31B PRIOR ART

The Johnson Method as shown in FIG. 30 illustrating Johnson '085 can be further understood from FIGS. 31A and 31B where a generic gripper arm is labeled 640. The gripper arm is mounted to an elevator which positions the arm at random vertical planes adjacent to the card stack 620 as shown in FIG. 31A. Referring to FIG. 31B, the gripper arm thereafter grasps a portion of the card stack 620U and lifts it upward, creating an opening to insert a playing card 626. The gripper arm thereafter lowers the upper stack onto the lower stack. The cycle is repeated until the desired number of cards are inserted randomly into the card stack 620.

Figure 32A:
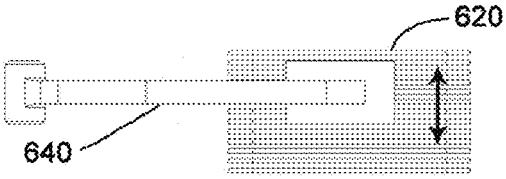
FIG. 32A PRIOR ART
FIGS. 32A and 32B illustrate the sequence of movements for injecting a card into a stack as taught by another prior art (2003) shuffling device.
Figure 32B:
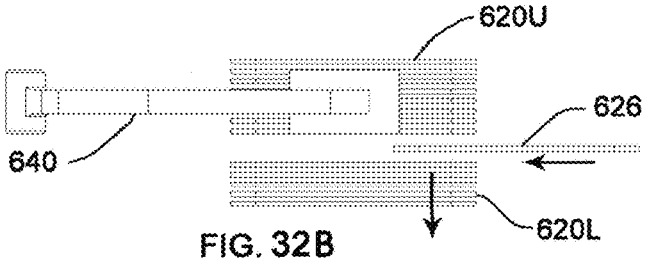
FIG. 32B PRIOR ART

Grauzer '982 also utilized a gripper to separate a card stack into two sub-stacks. Referring to FIGS. 32A and 32B, Grauzer '982 mounted the gripper arm 640 in a vertically stationary position and instead moved the card stack 620 with the elevator. After splitting the stack 620, the sub-stack 620L was lowered to create the opening for inserting card 626. After insertion, the lower substack 620L was thereafter raised to abut against the upper sub-stack 620U and the gripper was released. As compared to Johnson '085, Grauzer '982 lowered the lower sub-stack 620L rather than raising the upper sub-stack 620U as was taught by Johnson '085. Both prior art disclosures taught the advantages of avoiding narrow-slotted elevators.

Figure 14:
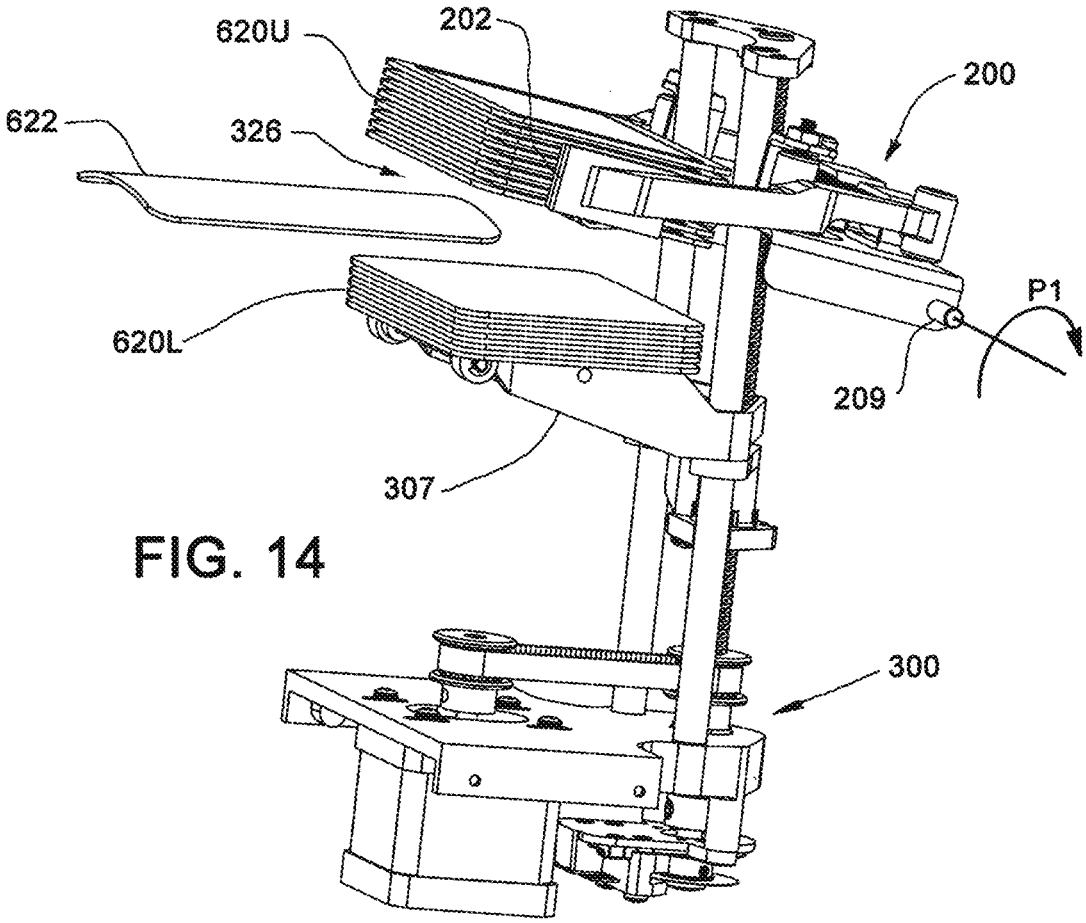
FIG. 14 is an isometric view of the gripper mechanism creating a random wedge-shaped opening between two sub-stacks of cards.

The randomizing mechanism of the present invention is devoid of narrow slots (or otherwise slot-less), carousels, combs, racks, or ejector blades that are previously known to be vulnerable to jamming. Referring to FIG. 14, a section of the card stack being randomized is raised by a gripper mechanism which creates a randomly chosen wedge-shaped opening for oblique insertion of a card from the unshuffled stack, raises an upper sub-stack, and thereafter lowers the upper sub-stack onto the newly inserted card. The large wedge-shaped opening is tolerant of the elevator position (also known as "position tolerant") during card insertion, thereby reducing the vulnerability to bent or warped cards.

Figure 11:
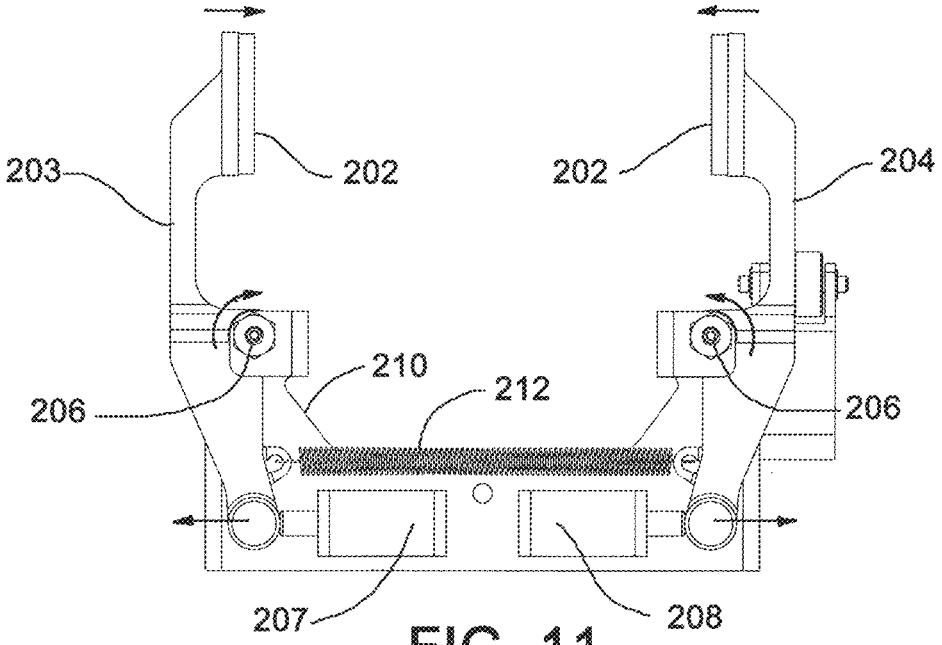
FIG. 11 is a planar view of the gripper mechanism used to randomize cards.
Figure 13:
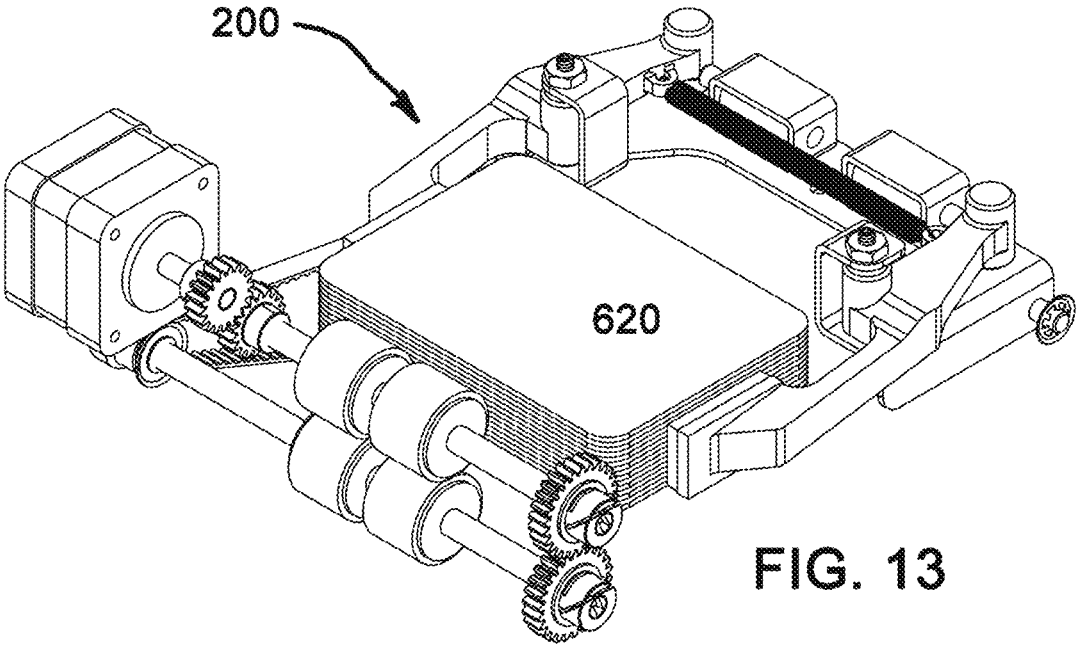
FIG. 13 is an isometric view of the gripper mechanism while grasping a stack of cards.
Figure 14A:
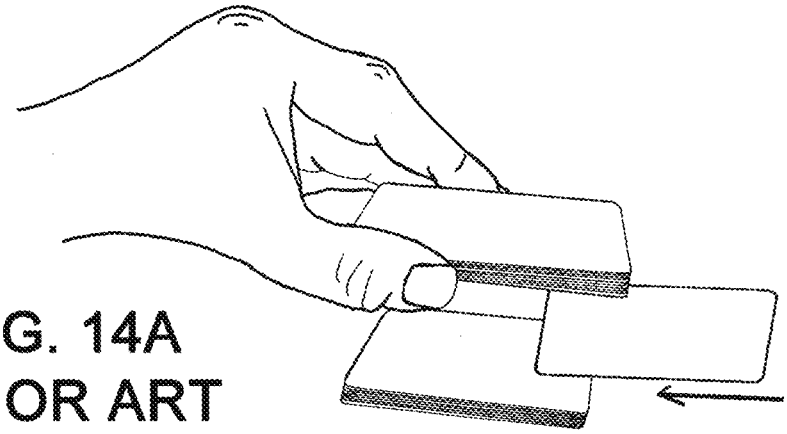
FIG. 14A PRIOR ART
FIG. 14A is a prior art illustration demonstrating a card dealer inserting a cut card into a card deck.

The randomizing method utilized herein also emulates the motion of a human dealer when cutting a card into a card deck as shown in prior art FIG. 14A. Referring to FIG. 11, a gripper assembly 200 emulates the gripping motion of a dealer's fingers. Two gripper pads 202 are mounted on the terminal ends of a first gripper arm 203 and a second gripper arm 204, with each pivoting upon pivot screws 206. The two arms are actuated by two small solenoids 207 and 208 which are mounted on the gripper frame 210. When the solenoids are activated, the arms 203, 204 and their associated pads 202 move in the direction of the arrows to pinch the lateral surfaces of a card stack as shown in FIG. 13. Upon deactivation of the solenoids 207, 208, the two arms 203, 204 are moved in the reverse direction by spring 212, which relaxes the grip and releases the card stack 620. In the relaxed position, there exists only slight clearance between the gripper pads 202 and the lateral surface of card stack 620.

Figure 12:
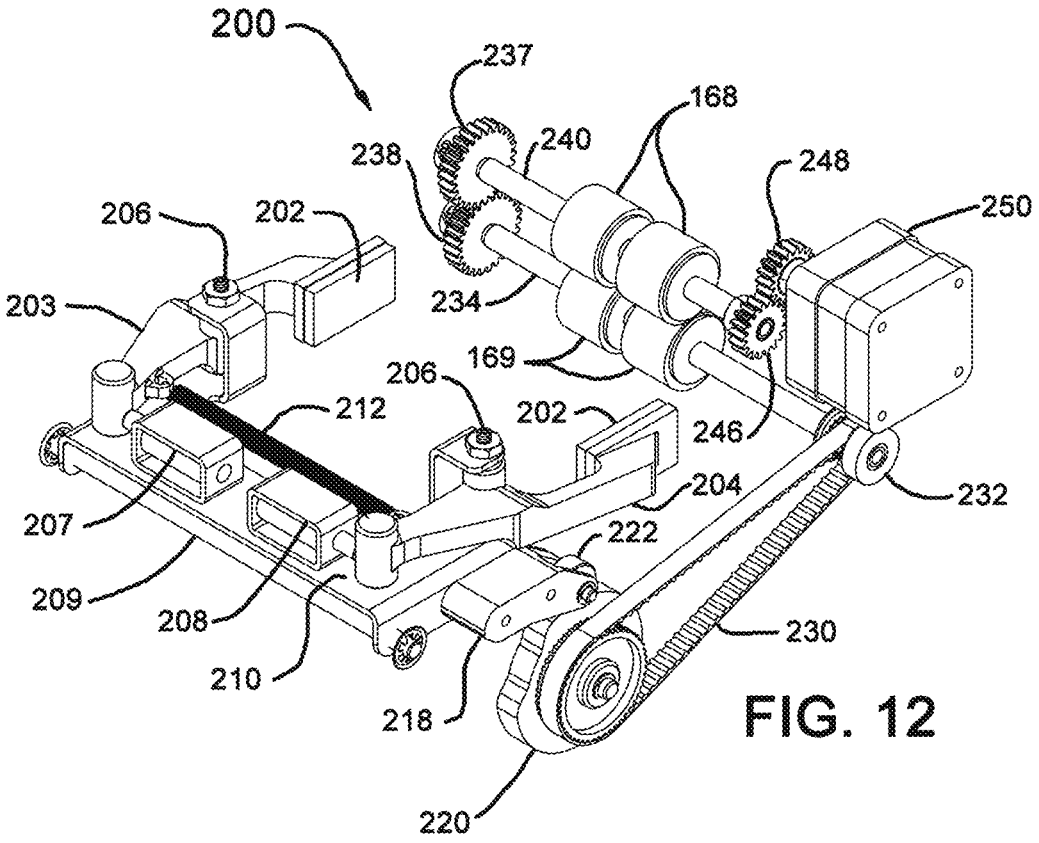
FIG. 12 is an isometric view of the gripper mechanism which is used to grasp and raise a substack of randomized cards.

The complete gripper assembly 200 is shown in FIG. 12 where the gripper frame 210 is pivotally mounted on a shaft 209. The pivotal mount allows the gripper frame 210, including gripper arms 203 and 204, to move in an arc after the gripper solenoids 207, 208 have been activated. A cam follower roll 222 is mounted to the follower mount 218 which is rigidly attached to the gripper frame 210. During the gripping cycle, at least one card of the card stack 620 is grasped by the gripper arms 203 and 204, and thereafter lifted by the cam 220 to move an upper sub-stack of cards 620U upward through an arc. The motion is illustrated in FIG. 14 where the upper sub-stack is shown as 620U.

Figure 15:
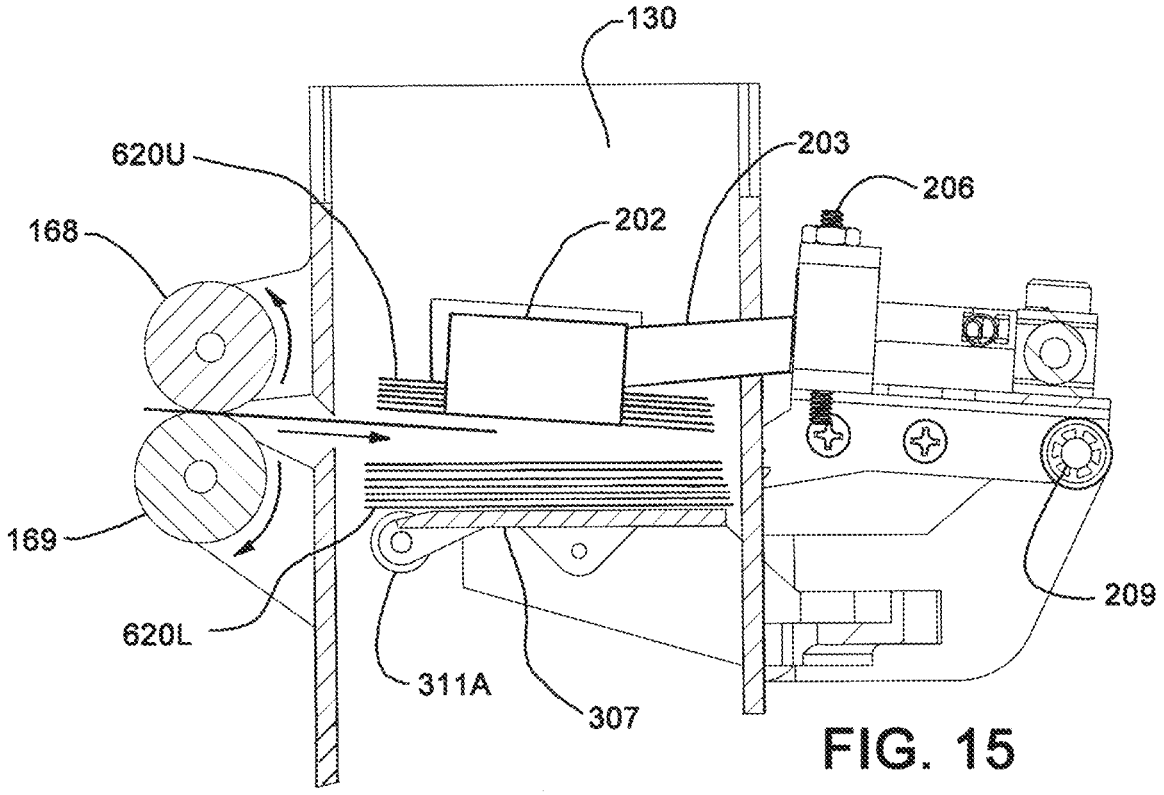
FIG. 15 is a cutaway side view of the randomizing mechanism showing a card being inserted into a randomly created wedge-shaped opening in the receiving card stack.
Figure 16:
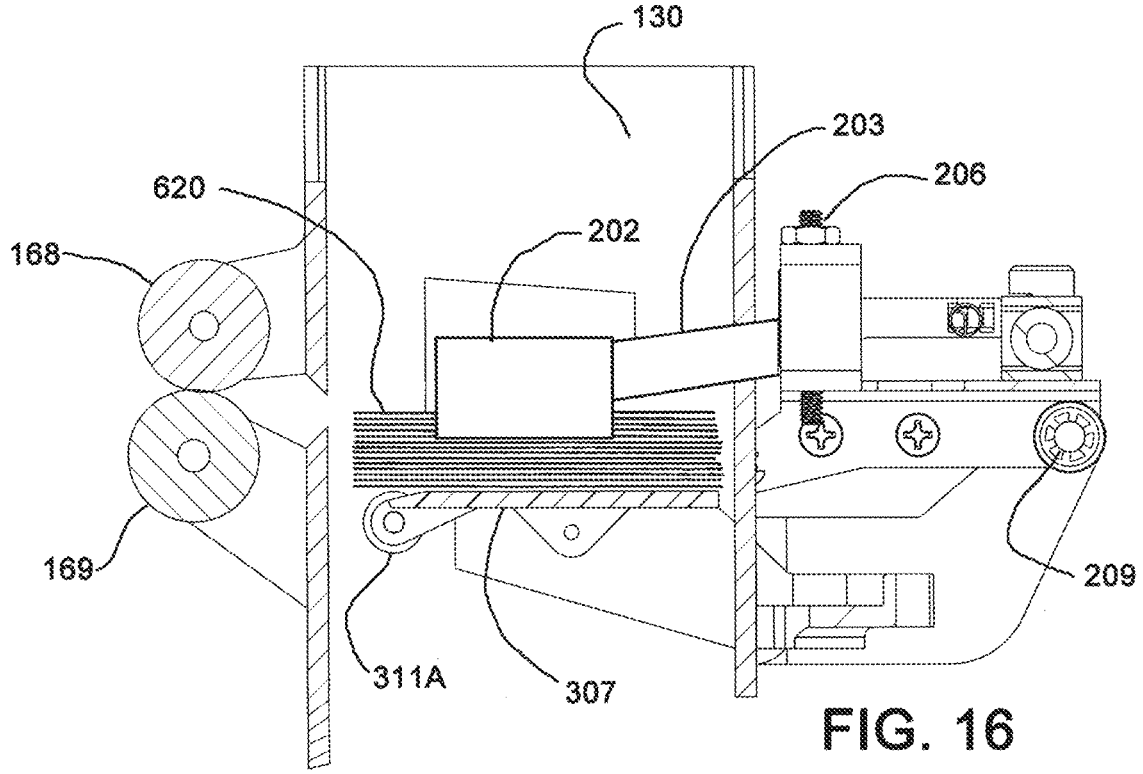
FIG. 16 is a cutaway side view of the randomizing mechanism showing the receiving card stack after the upper sub-stack has been lowered onto the newly inserted card by the gripper mechanism.

The elevator assembly 300 is used to position a card stack relative to the gripper mechanism 200, in order to allow the gripper assembly 200 to split the card stack into two sub-stacks, 620U, 620L. The orientation between the elevated, upper sub-stack 620U, the gripper assembly 200, the lower sub-stack 620L, and the elevator assembly 300 is shown in FIG. 14. A lower card sub-stack 620L is shown supported by the elevator platform 307, while an upper card sub-stack 620U is shown lifted in an arc about pivot P1 which is locationally fixed to the frame of game device 100. The vertical position of the split between the upper sub-stack 620U and the lower sub-stack 620L is determined by the microcontroller which relocates the elevator platform 307 just prior to the gripping cycle. As shown in the side elevation views of FIG. 15 and FIG. 16, the elevator platform 307 position a card stack 620 in a randomly selected elevation and the gripper assembly 200 thereafter splits the card stack through an arc at the random location. The lower sub-stack 620L is held stationary by the elevator platform 307 while the gripper arms 203, 204 raises the upper sub-stack 620U, and while a new card 622 is inserted into the wedge-shaped opening 326 (FIG. 14). As illustrated in FIG. 14, the axis of the elevator may form an angle with the surface of the casino table that is other than perpendicular.

The purpose of the cam 220 shown in FIG. 12 is two-fold. First, the gripper assembly 200 creates a large wedge-shaped opening 326 which is tolerant to curved or bent cards as illustrated by warped card 622 in FIG. 14. The large wedge-shaped opening 326 overcomes the jamming problem exhibited by prior art narrow slot carousel and moving comb shuffling devices which are commonly found in the art. Secondly, the cam 220 is designed to alleviate the cyclic life burden on the components of the elevator assembly 300.

The prior art devices that utilized gripper mechanisms (see prior art FIG. 31A through FIG. 32B) required three elevator motions for each card insertion; a first elevator motion to arrive at the splitting plane; a second elevator motion to split the deck into two sub-stacks; and a third elevator motion to merge the two sub-stacks together after each card insertion. For one deck of 52 cards, for example, the prior art elevators must shuttle through 156 (3×52) motion cycles. In contrast, the elevator assembly 300 of an embodiment of the present invention herein relocates just once during each card insertion cycle, thereby extending the service life of the elevator assembly 300 as compared to the prior art.

The previously described grasp-elevate-insert-release cycle is repeated for each of the cards in an unshuffled deck until all cards have been transferred to the card stack 620 in the randomizing chamber 186. The card stack 620 thus begins with one card and builds to a full deck of 52 cards in the case that 52 cards is the desired deck size. Each new card is inserted into the card stack 620 at randomly chosen elevated positions by the microcontroller, which utilizes a random number generating algorithm to determine the height of each plane between two adjacent cards within the receiving card stack 620. Random number generating algorithms are known in the art as RNG's. The RNG of card device 100 insures that each card is inserted into the stack 620 at a random position.

Termination of the randomizing cycle is detected by the microcontroller via sensor 129 (see FIG. 7A). Upon termination of the randomizing cycle, the microcontroller will determine if the shuffled card deck 620 is faulty. If the card deck 620 is not faulty, the microcontroller will thereafter direct the elevator to lower the deck to transfer roll 743 as shown in FIG. 7C. Conversely, if the resulting shuffled deck has been found faulty after the randomizing cycle has been completed, the elevator platform 307 will raise the faulty card deck 630 to the dual purpose portal 130 as shown in FIG. 7B.

Figure 17:
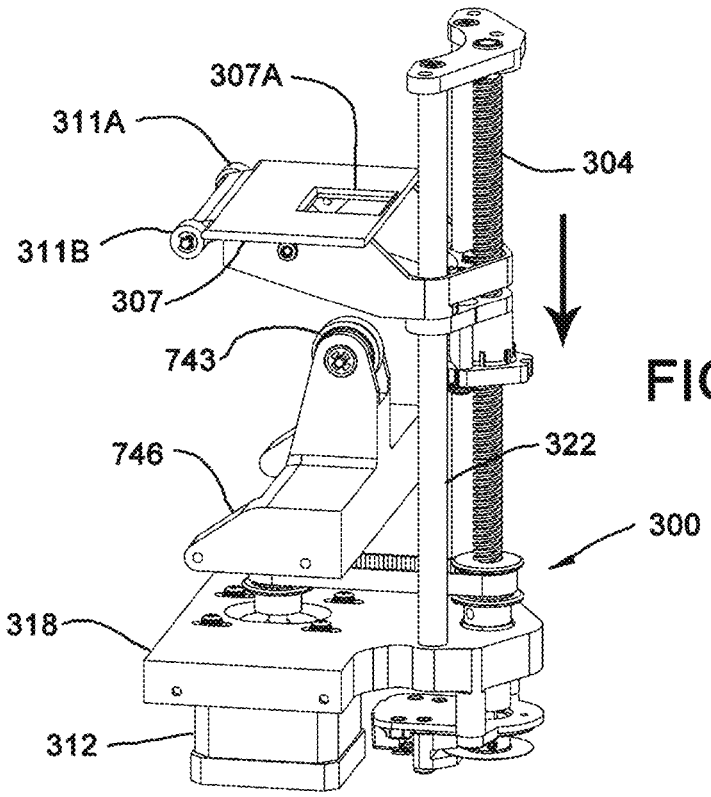
FIG. 17 is an isometric view showing the elevator platform moving downward towards a transfer roll.
Figure 18:
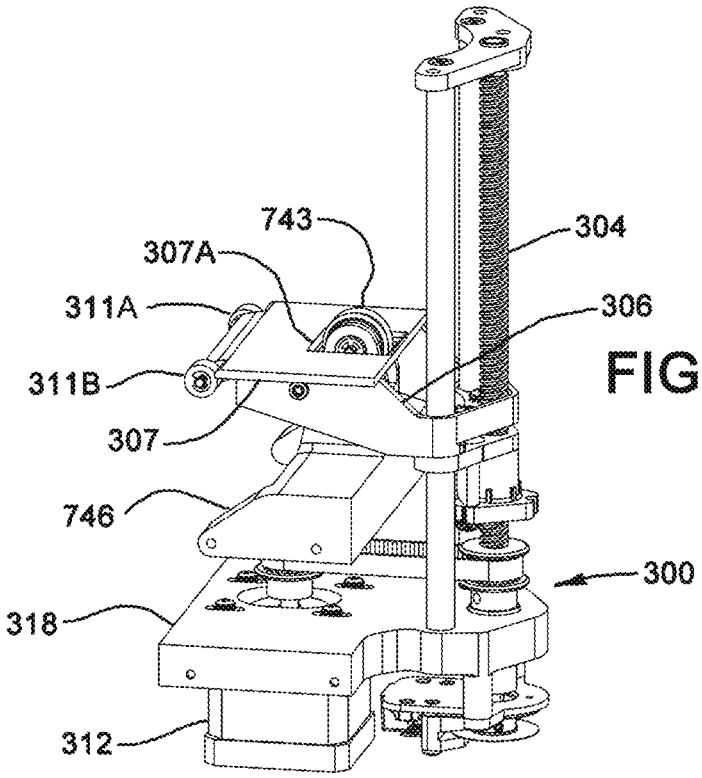
FIG. 18 is an isometric view showing the elevator platform being pierced by the transfer roll.

FIG. 17 illustrates an isometric view of the elevator assembly 300 and the transfer roll 743. The elevator assembly 300 is supported by platform 318 which is rigidly attached to the side frames of game device 100. The freely rotatable transfer roll 743 is supported by support frame 746 which is also rigidly attached to the side frames. Platform 307 possesses a cavity 307A which is designed to allow the transfer roll 743 to pierce the plane of the platform 307. In addition, freely rotatable rollers 311A and 311B are attached at one edge of platform 307. FIG. 18 illustrates the condition where the lead screw 304 has lowered the elevator platform 307 to a level whereupon the transfer roll 743 has pierced the plane of the platform 307 as the roll 743 moves through the cavity 307A.

Figure 19:
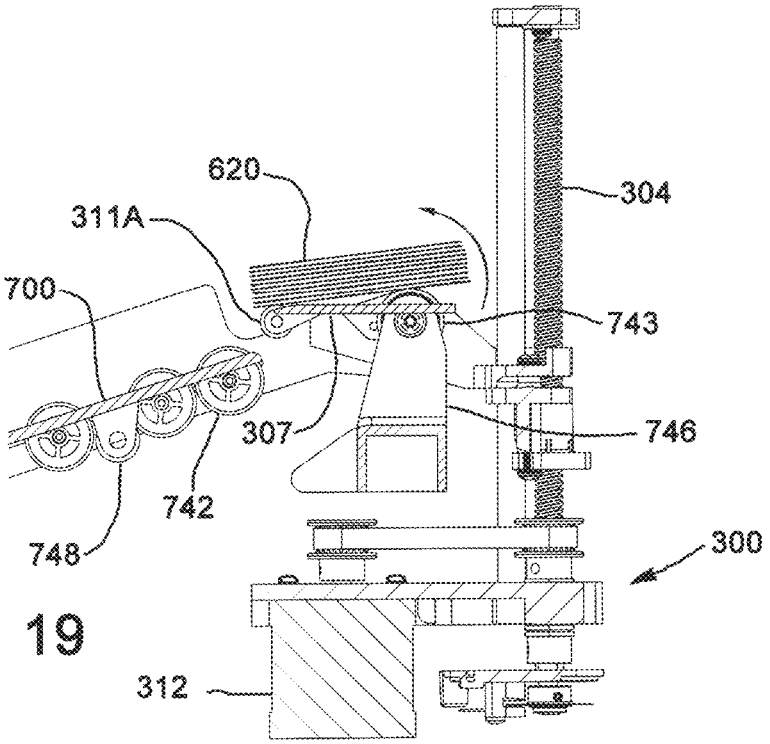
FIG. 19 and FIG. 20 are cutaway section views showing a sequence of movements as the transfer roll removes a card deck from the elevator platform.
Figure 20:
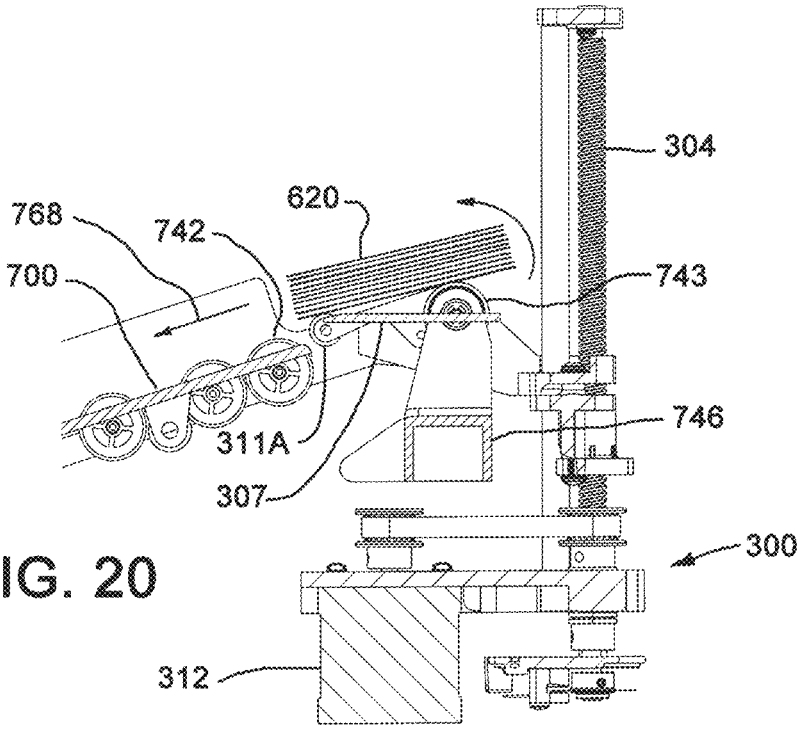

FIG. 19 and FIG. 20 show isolated section views with the elevator assembly 300 and transfer roll 743 which illustrates the process of transferring the play-ready card deck 620 to discharge track 700 in the preferred embodiment. As the elevator platform 307 is lowered toward a discharge position in FIG. 20, the play-ready card deck 620 first makes contact with freely rotating transfer roll 743, near one edge of the deck, which induces the play-ready card deck 620 to begin rotating counterclockwise as indicated by the circular arrow. In FIG. 19, the play-ready card deck 620 is partially supported by the roll 311A and the transfer roll 743 while the elevator platform 307 is moving downward toward a recessed position. As the elevator platform 307 continues moving downward, the play-ready card deck 620 continues to rotate until achieving a critical release angle as shown in FIG. 20. Centrifugal force is induced by the sudden rotation of the card deck mass and is utilized to change the direction of the card deck to the direction of the arrow 768 where inertia thereafter takes the card deck 620 to its output tray destination. The card deck transfer from the elevator platform 307 to its output tray destination thus takes place by centrifugal force and inertia. In an alternate embodiment, the transfer roll 743 is not freely rotatable, but is instead motor driven so as to speed up the deck transfer. After a pause, the elevator platform 307 may thereafter be raised to the randomizing chamber 186 whereupon the randomization of another deck can commence. The game device configuration herein allows a second deck to commence randomization while a first play-ready deck has been delivered to one of the two output trays 142 or 143.

Figure 21:
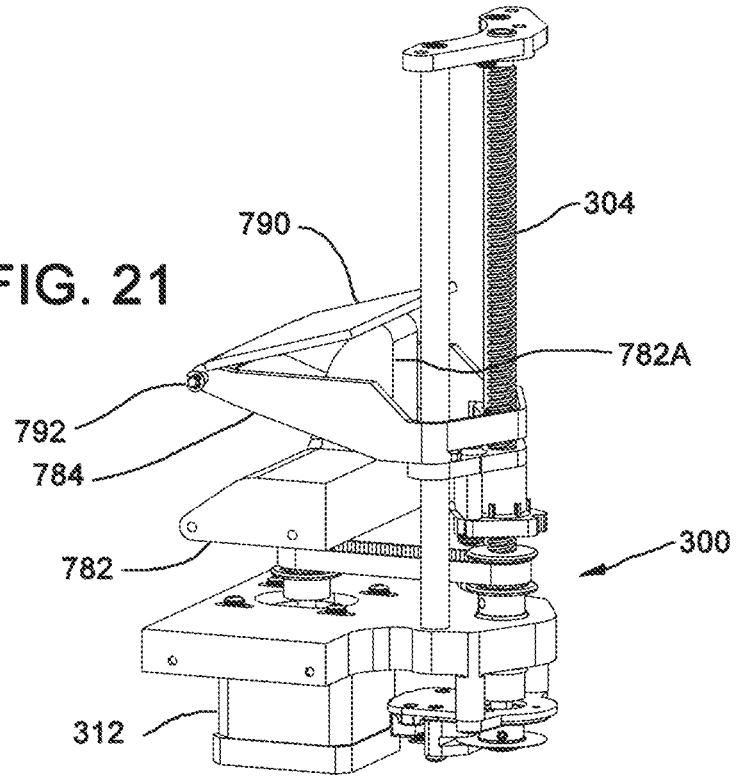
FIG. 21 is an isometric view of an alternative mechanism for removing a deck from the elevator by tilting the elevator platform.
Figure 22:
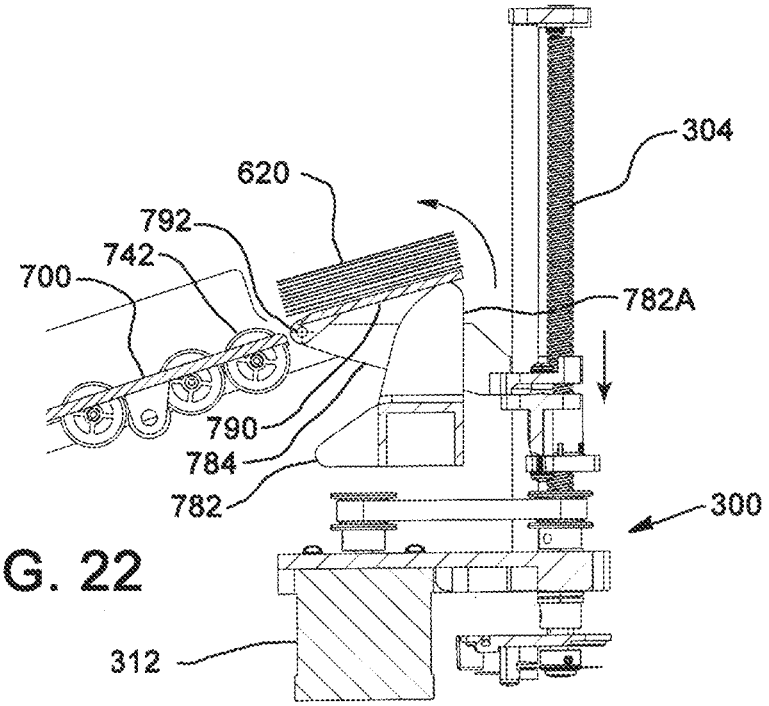
FIG. 22 is a section view of the mechanism shown in FIG. 21.

In an alternate embodiment, the operational transfer of the deck 620 to the discharge track 700 is executed by the mechanism shown in FIG. 21 and FIG. 22. Referring to FIG. 21, elevator assembly 300 utilizes a lead screw 304 to vertically move a tiltable elevator platform 790 which is pivotally mounted to a pair of elevator arms 784. The platform 790 pivots upon an axle 792 which is rigidly attached to the elevator arms 784. An abutment 782A extends from it support 782 which is rigidly attached to the side frames of game device 100. The isometric view in FIG. 21 explains that the abutment 782A contacts the tiltable platform 790 as the elevator arms 784 are lowered. The section view of FIG. 22 illustrates that the card deck 620 slides off the tilted elevator platform 790 as the elevator is lowered.

Figure 23:
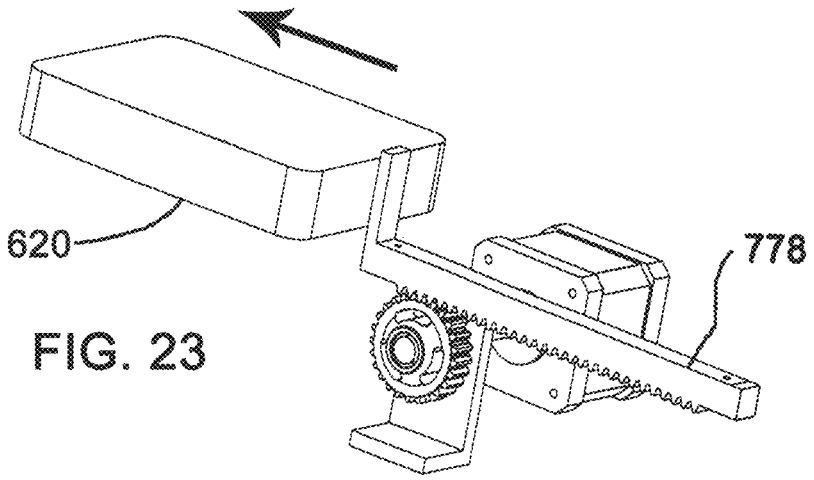
FIG. 23 is an isometric view of an alternative mechanism for removing a deck from the elevator using a mechanical arm.
Figure 24:
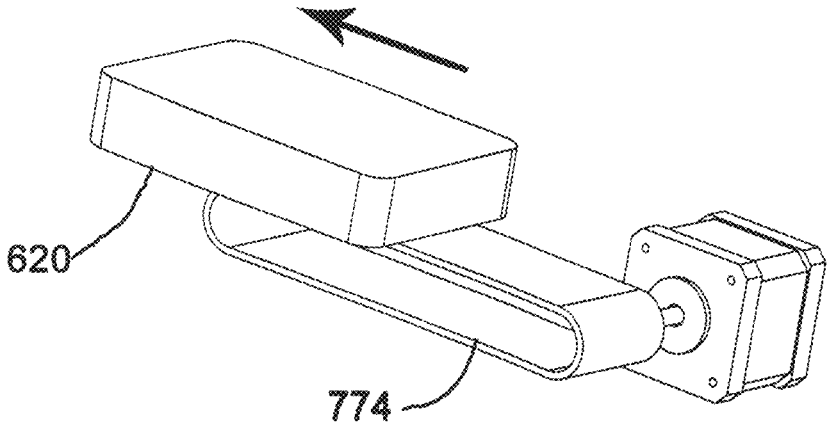
FIG. 24 is an isometric view of an alternative mechanism for removing a deck from the elevator using a belt.

In another embodiment, removal of the play-ready deck 620 from the elevator is propelled by a mechanical arm 778 as shown in FIG. 23. Although shown moving linearly, the mechanical arm could rotate to remove a card deck from the elevator. In yet another embodiment, a moving belt 774 removes the card deck from the elevator as shown in FIG. 24. Similar card moving mechanisms are well known in the art.

A cam 746 is oriented by motor 744 to establish the angle of the output track 700 as shown in FIG. 7D and FIG. 7E. Upon each completion of a deck shuffle that yields a game-ready deck, the microcontroller will decide whether to send that deck to output tray "1" or output tray "2" by orienting the position of cam 746 which in turn sets the angle of the discharge tray 700. In the case that both output trays are empty, the microcontroller will use a random number generator to randomly orient the discharge tray 700 by choosing amongst two positions of the cam 746. In one embodiment, the microcontroller uses a rolling 8-bit counter having a numerical range from 0 to 255 for this purpose. A number is extracted from this counter as triggered by the moment that a deck in the shuffling chamber 186 is found to be verified. If the extracted number is an odd number, the microcontroller routes the verified deck to output tray "1". In the case of an even number, the microcontroller routes the deck to output tray "2". The delivery of the decks to the output trays is concealed from view by the hood 155 such that the delivery sequence is not detectable by the players or dealer.

Figure 25:
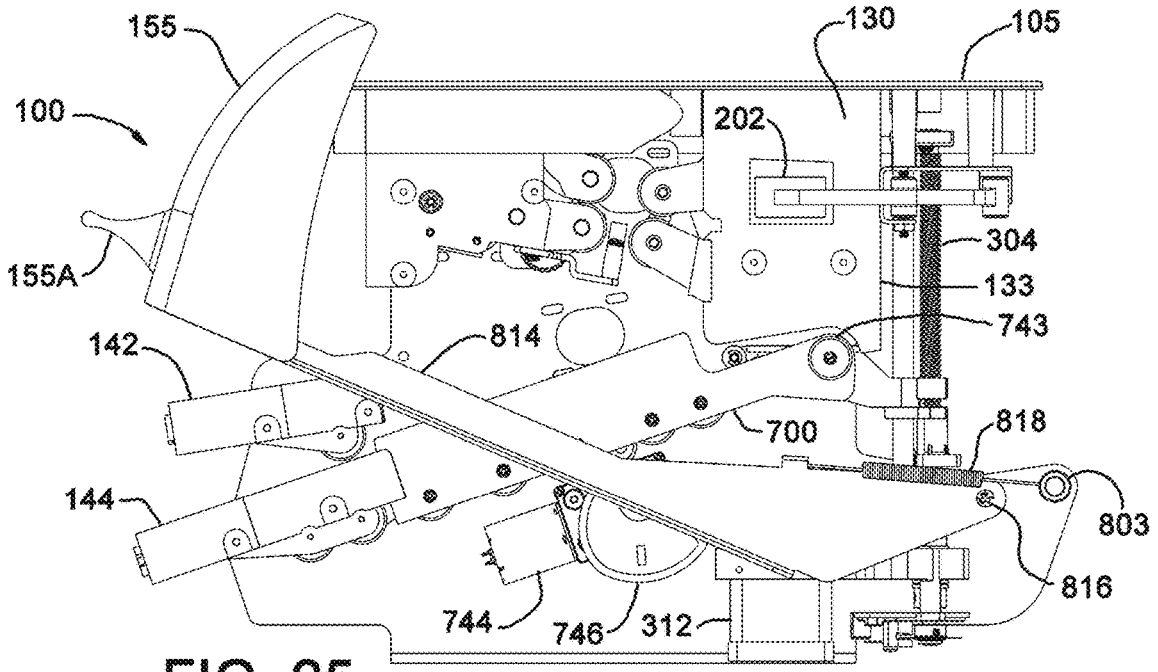
FIG. 25 is a side elevation view of the suspension mechanism that supports the moveable hood.

FIG. 25 illustrates the suspension of the hood 155 that is utilized to conceal the discharge port 140. In FIG. 25, the hood 155 is shown in its "open" position which allows access to the output trays 142 and 144. The hood 155 is an injection molded casing component that is mounted to a pair of pivoting arms 814 which pivot upon posts 816. The posts 816 are rigidly attached to the side frames of game device 100. The hood 155 is grasped by the dealer using projection 155A to elevate the hood to the upper limit position as shown in FIG. 25. Over center spring 818 is anchored on post 803, which maintains the hood stably is this "open" position. The dealer may also lower the hood to its alternate "closed" position by grasping projection 155A. In an alternate embodiment, the hood 155 is raised and lowered by a motor as triggered by touchscreen commands.

The game which utilizes the game device 100 described herein is a multiplayer card game for three to seven players similar to Twenty-One which is played at a seven-position casino table. In comparison to the conventional game of Twenty-One, the game herein adds more mystery and chance while being easy to understand and play. In addition to multiplying or losing their own bets by playing against the dealer, players are randomly given the opportunity to take the bets of the other players by capturing the table stakes. The game is initiated when one player is chosen as a symbolic "HOST" and thereafter chooses one deck from amongst two available decks for the game. Before making that choice, the players are made aware that one deck is a conventional card deck containing 52 cards. The other deck is a "premium deck" which contains 52 cards which include nonconventional cards. The "premium deck" is configured by removing four sixes from a conventional 52 card deck and replacing them with four nonconventional cards. In one embodiment, the nonconventional cards are "instant winner" cards as illustrated in FIG. 27 and FIG. 28.

Figure 27:
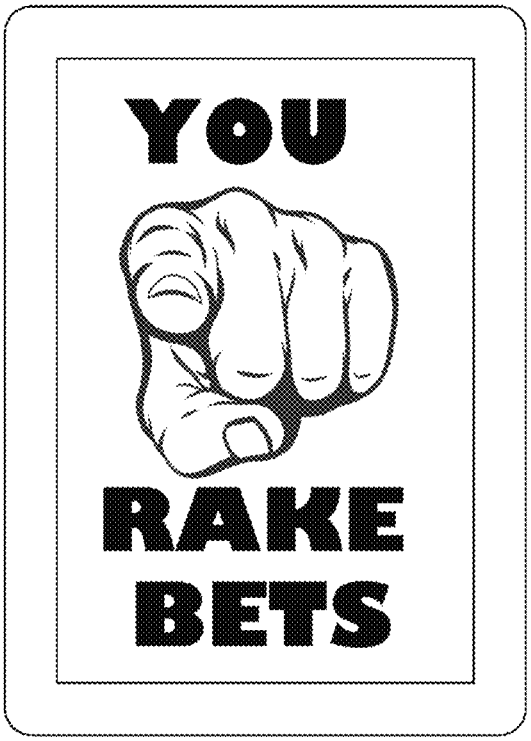
FIG. 27 is an illustration of an "instant winner" card used in the card game being explained herein.
Figure 28:
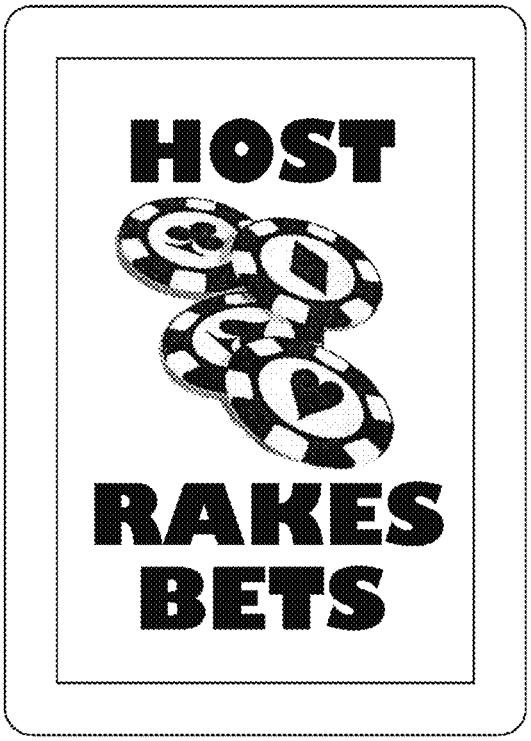
FIG. 28 is an illustration of another "instant winner" card used in the card game being explained herein.

The "premium deck" in one embodiment contains two of the "instant winner" cards shown in FIG. 27 and two of the "instant winner" cards shown in FIG. 28. When a player or dealer receives the "YOU RAKE BETS" card, the round is immediately over, and the card holder is awarded the table stakes. If any player or dealer receives the "HOST RAKES BETS" card as shown in FIG. 28, the round is over, and the "HOST" automatically wins all bets placed into the table stakes. Since the dealer cannot be the "HOST", the house cannot win on the "instant winner" card illustrated in FIG. 28.

Prior to initiating the game, the dealer will load and shuffle two decks sequentially. The first deck may be the conventional deck or the "premium deck". When the first deck shuffle is completed, the touch screen 114 displays prompts that the second deck may be inserted into the portal 120. In the meanwhile, the first deck has been directed into one of the two output trays randomly by the microcontroller. The second deck is thereafter shuffled and directed to the remaining output tray by the microcontroller. During the time of shuffling and deck transit, the hood 155 is kept in the closed position which conceals the arrival of each deck at the two output trays 142 or 144. Neither the dealer nor the players can detect which of the two output trays had received the "premium deck".

Figure 26:
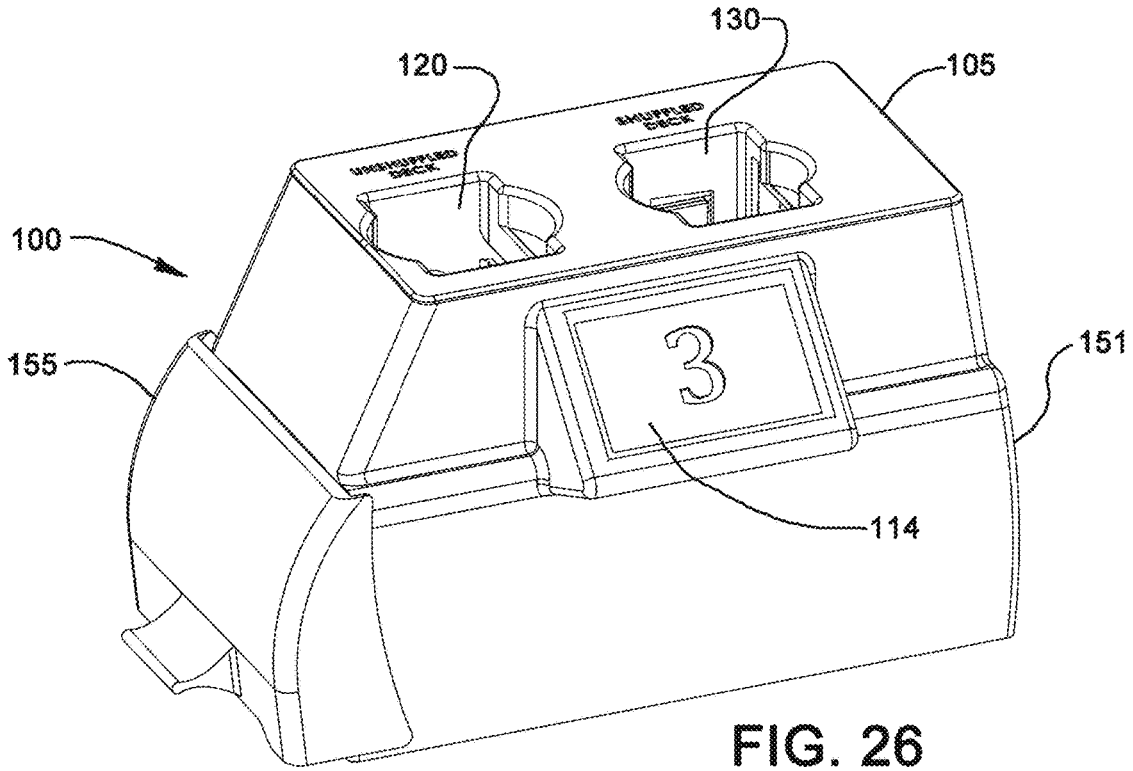
FIG. 26 is an isometric view of the game device illustrating the state of the touch screen display after designating a table position for initiating the card game being explained herein.

After the players are seated, the dealer commences the game by utilizing the game device to choose a player to act as the symbolic "HOST" for the game. This is achieved by prompting a request on the touch screen for the game device to randomly choose a player position number between one and seven, where the number correlates to the seat positions at the casino table. The game device responds by utilizing a random number generator algorithm (RNG) to generate a number between one and seven. As shown in FIG. 26, that randomly generated seat position is then displayed in large numerals on the touch screen such that the number can be easily observed by all players. In the example of FIG. 26 the role of game "HOST" is assigned to the player seated at the table position designated position "3". The role of "HOST" is symbolic only, in that the "HOST" does not handle cards or chips. Rather, the dealer operates the game device and handles the cards and chips, but the HOST may gain advantage according to the "instant winner" cards.

Once having designated the game's "HOST", the dealer displaces the hood 155 to reveal the two play-ready decks as shown in FIG. 3. The "premium deck" resides in one of the two trays, buts its location is unknown to the players or dealer. The "HOST" must thereafter choose one of those two decks from output tray "1" or output tray "2" with which to initiate first playing round.

Figure 4:
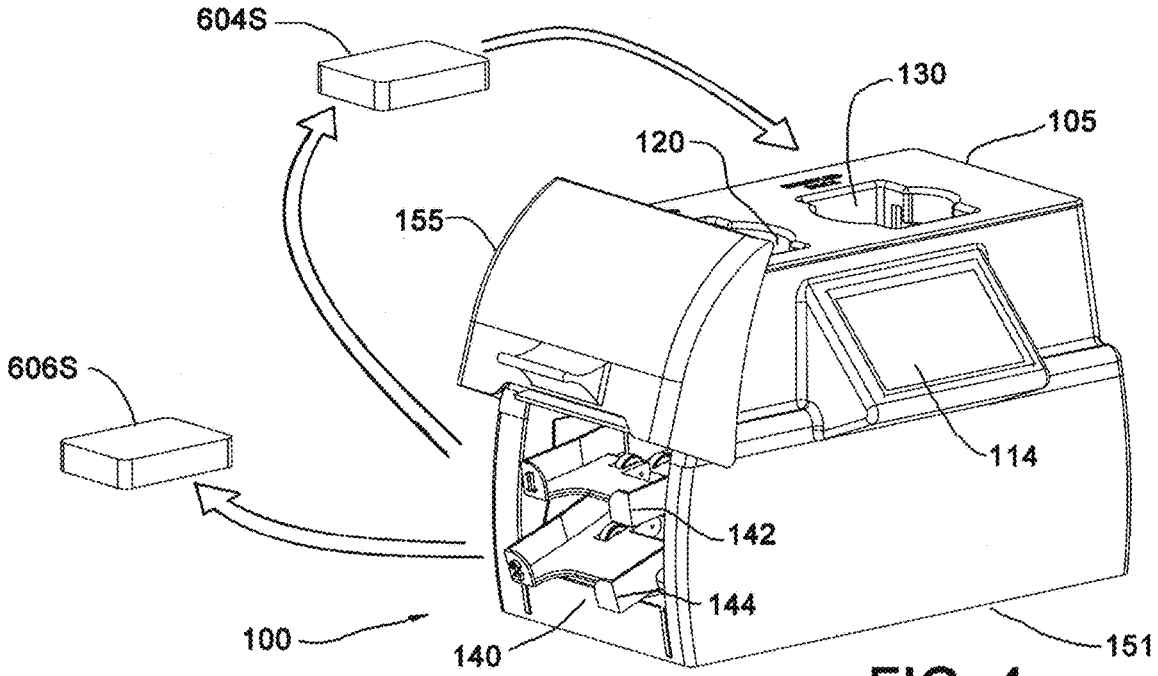
FIG. 4 is a perspective view of the game device described herein illustrating the exemplary transit routes of the two game-ready decks after one of the two decks has been designated for utilization in a subsequent card game.

The deck chosen by the HOST is then moved to a shoe from which the cards will be dealt one by one for the successive game. As shown in FIG. 4, the non-chosen deck 604S will be removed from its output tray and recirculated into dual use portal 130 of the game device 100 where it will eventually by randomly directed to one of the output trays for the next game.

The game will thereafter commence according to the rules and procedures that are listed below. The dealer will deliver two face-up cards to each player one card at a time and then one card face-up and one card face-down to himself as is done in the conventional game of Twenty One. Each player must place their bet before the round is dealt and the goal is to beat the dealer's hand without exceeding 21 points. If the "HOST" has been lucky enough to have chosen the "premium deck", then excitement will grow when the first "instant winner" card emerges. From there, the players will know that there exists more "instant winner" cards in the shoe, and each player will be more likely to raise their bets to stay in the round as they anticipate the chance of receiving an "instant winner" card.

Once an "instant winner" card emerges, that round will be immediately terminated and the table stakes will be taken by the HOST or another player according to the content of that particular "instant winner" card. The dealer will then collect the spent cards and deal the next round. Normally, the game will consist of between two and three rounds depending upon the number of players, where three rounds can be played from one deck with five or less players.

After all rounds have been played from the chosen deck, the dealer will collect the cards and place them into the input portal 120 of the game device 100. After closing the hood 155, the dealer can then acuate a "shuffle" command upon the touch screen 114, whereupon the device will respond by moving the deck 604S (see FIG. 4) to a randomly chosen output tray and thereafter commencing the shuffling operation of the deck residing in portal 120. Barring detection of a faulty deck, the play-ready deck emanating from the shuffling chamber will be directed to the vacant output tray which is concealed within output portal 140. The game device 100 is then ready to commence the next game, including designating another "HOST".

In general, the rules and procedures of the game are briefly set forth as follows.

Objective: Beat the dealer by accumulating card values closer to 21 than the dealer, without exceeding a total value of 21.

Value of Cards:

1) Face cards King, Queen and Jack are worth 10 points.
2) Aces can be worth 1 or 11 points, whichever benefits the player.
3) Numeral cards 2 through 10 are worth the value on their face.
4) Nonconventional "instant winner" cards terminate the round with table stakes awarded to the designee.

Game Procedure:

1) After players are seated, the Dealer requests the game device to randomly choose a table position.
2) The player occupying the table position chosen by the game device is designated as the game's symbolic "HOST".
3) Dealer displaces the game device hood to reveal two decks of verified cards.
4) The "HOST" chooses one or the other deck for game play.
5) Dealer places the chosen deck into a shoe.
6) Dealer deposits the remaining deck into the game device.
7) Each player places a bet.
8) Dealer deals two cards face-up to each player.
9) Dealer deals one card face-up and one card face-down to himself/herself.
10) Each player must decide to stand or take another card (HIT)
11) A player may take multiple HITS until exceeding 21.
12) Dealer reveals the face-down card after each player has finished either standing or taking HITS.

12) Dealer must HIT until his/her total exceeds 17 or higher.
13) At completion of each round, the dealer deals another round, dependent upon the number of players.
14) After completing the rounds, the Dealer collects the used cards and returns them to the game device for shuffling and verification.

How to Win:

1) The appearance of any "instant winner" card entitles the recipient or the HOST to collect the table stakes and the round is immediately terminated.
2) If a player exceeds 21 (busts), the player loses their bet to the house.
3) If the dealer exceeds 21 (busts), all remaining players win, and the round is terminated.
4) If neither the dealer nor player exceeds 21, the hand with a score closest to 21 wins.
5) If a player and dealer points are tied, no one wins or loses, and the round is terminated.

The game herein is similar to the game of Twenty-One and is therefore easy to understand and play. However, the game adds more mystery and chance while giving each player a statistical chance to take the table stakes during a round. Players benefit from the additional chances of winning and the house benefits from the tendency of players to bet less conservatively when hoping to receive an "instant winner" card.

In an alternate embodiment, one of two decks contains a highly publicized prize card, such as a nonconventional card that awards a high value prize such as a cruise or a week's stay in the casino's hotel. In this embodiment, the dealer may display that prize card to the players when he inserts it into one of the two decks before entering that deck to be shuffled. In this embodiment, the emergence of the publicized prize card will terminate that round, and the players will keep their bets for the next round.

One of ordinary skill, having designer's choice, may choose to utilize different forms of actuators, sensors and transport components as described herein. Other types of motors and solenoids are also logical substitutions. Other forms of nonconventional card designs and card deck configurations can be substituted without violating the spirit of the invention. The game may be adjusted by other game variations such as splitting a hand and side bets which are known in the art, or individual casinos may formulate an alternate set of rules.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A method of playing a card game with multiple decks of cards, said method comprising;

receiving multiple unshuffled decks of cards into a card handling device one deck at a time;

executing an algorithm with a microcontroller to randomize a physical order of the cards within each deck in the card handling device;

receiving each randomized deck upon an elevator for movement to a discharge portal having multiple output trays;

storing multiple randomized decks within the multiple output trays;

randomly choosing one of the stored decks from amongst the multiple output trays;

distributing the cards of the one randomly chosen deck to game players; and determining the game winner.

2. The method of claim 1 further including moving individual cards past a sensor within the card handling device to determine if eachdeck is faulty.

3. The method of claim 2 further comprising moving a faulty deck to a portal within the card handling device with the elevator.

4. The method of claim 2 further comprising notifying the device operator of the faulty deck determination.

5. The method of claim 1 further including transferring each randomized deck from the elevator to one of the output trays along a discharge track.

6. The method of claim 5 further comprising adjusting an angle of the discharge track to align with one of the multiple output trays.

7. The method of claim 6 including executing an RNG algorithm with the microcontroller to choose the angle of the discharge track.

8. The method of claim 6 further comprising adjusting the discharge track angle to align with one of the multiple output trays by using a motor-driven cam.

9. The method of claim 1 further comprising concealing the stored decks within the multiple output trays with a moveable barrier.

10. The method of claim 9 further comprising the step of revealing the stored decks to the game players by displacing the moveable barrier.

11. The method of claim 1 further comprising embedding nonconventional cards having no rank or suit indicia into the multiple decks.

12. The method of claim 1 wherein the step of choosing the one randomly chosen deck is performed by a designated game host.

13. The method of claim 12 wherein the step of designating the game host is performed by the microcontroller utilizing an RNG algorithm.

14. The method of claim 1 wherein the step of determining the game winner includes dealing individual cards from the one randomly chosen deck to each player according to a set of pre-established game rules.

15. The method a claim 1 wherein the step of determining the game winner includes dealing nonconventional cards to a designated game host from the one randomly chosen deck.

16. The method a claim 1 wherein the step of determining the game winner includes dealing nonconventional cards to any game player from the one randomly chosen deck.

17. The method of claim 1 further including recirculating decks into the card handling device.

18. The method of claim 17 wherein the step of recirculating decks includes manually moving a stored deck from its output tray to an input portal of the card handling device.

* * * * *